US011357690B2

(12) United States Patent
Ali

(10) Patent No.: US 11,357,690 B2
(45) Date of Patent: Jun. 14, 2022

(54) APPARATUSES FOR ARM EXERCISE

(71) Applicant: BEABLE HEALTH PVT LTD, Telangana (IN)

(72) Inventor: Habib Ali, Telangana (IN)

(73) Assignee: BEABLE HEALTH PVT LTD, Hyderabad (IN)

( * ) Notice: Subject to any disclaimer, the term of this patent is extended or adjusted under 35 U.S.C. 154(b) by 252 days.

(21) Appl. No.: 16/631,300

(22) PCT Filed: Jul. 18, 2018

(86) PCT No.: PCT/IB2018/055332

§ 371 (c)(1),
(2) Date: Jan. 15, 2020

(87) PCT Pub. No.: WO2019/016720

PCT Pub. Date: Jan. 24, 2019

(65) Prior Publication Data

US 2020/0222265 A1 Jul. 16, 2020

(30) Foreign Application Priority Data

Jul. 18, 2017 (IN) ..... 201741025539

(51) Int. Cl.
*A61H 1/02* (2006.01)
*A63B 1/00* (2006.01)
*A63B 23/12* (2006.01)

(52) U.S. Cl.
CPC ..... *A61H 1/0285* (2013.01); *A63B 1/00* (2013.01); *A63B 23/12* (2013.01);
(Continued)

(58) Field of Classification Search
CPC ..... A61H 1/0274–0288; A61H 2201/1635–1638;
(Continued)

(56) References Cited

U.S. PATENT DOCUMENTS 4,930,769 A * 6/1990 Nenoff ..... A63B 21/068 482/142
2006/0194677 A1* 8/2006 Whitall ..... A63B 23/1281 482/92

(Continued)

FOREIGN PATENT DOCUMENTS

CN 105982810 A 10/2016
GB 2459379 A 10/2009

(Continued)

OTHER PUBLICATIONS

International Search Report from PCT Application No. PCT/IB2018/055332, dated Nov. 12, 2018.

*Primary Examiner* — Valerie L Woodward
*Assistant Examiner* — Paige Kathleen Bugg
(74) *Attorney, Agent, or Firm* — Budzyn IP Law, LLC

(57) ABSTRACT

The invention comprises an apparatus for arm exercise for therapy of a subject. The apparatus comprises a base comprising a planar upper surface. A first set of parallel rails are affixed to said upper surface of the base, the first set of parallel rails comprising a first rail and a second rail positioned parallel to each other and separated from each other by a predefined first distance. A second set of rails comprising at least a third rail having a first end and a second end are also provided, wherein said first end is slidably mounted on the first rail and said second end is slidably mounted on said second end. A sliding mount is slidably affixed to the second set of rails, and configured such that said sliding mount can be slidingly moved between the first end and the second end of the third rail.

14 Claims, 24 Drawing Sheets

(52) U.S. Cl.
CPC ..... *A61H 2201/0126* (2013.01); *A61H 2201/0192* (2013.01); *A61H 2201/1261* (2013.01); *A61H 2201/1619* (2013.01); *A61H 2201/1635* (2013.01); *A61H 2201/1645* (2013.01); *A61H 2201/1666* (2013.01); *A61H 2201/501* (2013.01); *A61H 2201/5043* (2013.01); *A61H 2201/5061* (2013.01); *A61H 2201/5069* (2013.01); *A61H 2201/5079* (2013.01); *A61H 2201/5084* (2013.01); *A61H 2203/0406* (2013.01); *A61H 2203/0425* (2013.01)

(58) Field of Classification Search
CPC ..... A61H 2201/5043–5046; A61H 2201/5058–5071; A61H 2205/06–067; A61H 2203/0406; A61H 2203/0425; A63B 1/00; A63B 21/4035; A63B 21/4045; A63B 23/12; A63B 23/1281; A63B 71/0622
See application file for complete search history.

(56) References Cited

U.S. PATENT DOCUMENTS

| | | | | |
|---|---|---|---|---|
| 2008/0153682 | A1* | 6/2008 | Chen | A63B 23/12 482/136 |
| 2011/0300994 | A1* | 12/2011 | Verkaaik | A63B 21/159 482/51 |
| 2014/0296750 | A1* | 10/2014 | Einav | A61H 1/0262 601/5 |
| 2015/0133828 | A1 | 5/2015 | Hachisuka et al. | |
| 2017/0095391 | A1* | 4/2017 | Sapin | A61B 5/4064 |
| 2017/0296860 | A1* | 10/2017 | Watry | A63B 21/4035 |

FOREIGN PATENT DOCUMENTS

| | | | |
|---|---|---|---|
| KR | 101744047 | B1 | 6/2017 |
| WO | 2016149652 | A1 | 9/2016 |

* cited by examiner

APPARATUSES FOR ARM EXERCISE

CROSS REFERENCE TO RELATED APPLICATION

This application is a National Stage Application under 35 U.S.C. § 371 of PCT Application No. PCT/IB2018/055332, filed Jul. 18, 2018, which claims priority from and the benefit of the filing date of Indian Provisional Patent Application No. 201741025539 filed on Jul. 18, 2017, which are hereby incorporated by reference in their respective entireties.

FIELD OF THE INVENTION

The present invention relates to an apparatus for bilateral arm or hand training for subject's suffering from a paretic arm or hand condition. In particular the invention provides an apparatus for bilateral arm exercises that facilitate physical and neural stimulation for the purposes of recapturing and relearning motor function in the subject's arm(s) or hands.

BACKGROUND

Paralysis or partial paralysis involving arms or hands has serious consequences for subjects. While such subjects have been known to gradually recover some part of the motor function in the paralyzed extremity, it is believed that use of training devices to increase repetitions increases the degree of movement and extent of recovery.

Commercially available devices however, have been found to suffer from multiple drawbacks, including over-emphasizing strength training, under emphasizing dexterity training, and being essentially reliant on muscle growth rather than on improving motor control and leveraging neuroplasticity.

Additionally, the nature of repetitive non-goal based training using the prior art devices is that patients are reluctant to continue using such devices, and overtime revert to inactivity—which slows down the recovery process.

There is accordingly a need for a bilateral arm exerciser that offers an intensive, engaging home or hospital/clinic based therapy for patients with upper extremity impairments, such as hemiparesis, hemiplegia, ataxia etc., and in cases where the upper extremity needs to enable a diverse range of motion based exercises. There is additionally a need for a device that quantifies movement, tracking of sessions and motivating a subject, while strengthening muscles, improving coordination and drives the subject towards voluntarily increasing repetitions—all of which would be helpful in overall neurological and physical recovery.

SUMMARY

The present invention relates to an apparatus for bilateral arm or hand training In particular the invention provides an apparatus for bilateral arm exercises that facilitate physical and neural stimulation for the purposes of recapturing and relearning motor function in the subject's arm(s) or hands.

In an embodiment, the invention comprises an apparatus for bilateral arm exercise for therapy of a subject. The apparatus comprises a base comprising a planar upper surface. A first set of parallel rails are affixed to said upper surface of the base, the first set of parallel rails comprising a first rail and a second rail positioned parallel to each other and separated from each other by a predefined first distance.

A second set of rails comprising at least a third rail having a first end and a second end are also provided, wherein said first end is slidably mounted on the first rail and said second end is slidably mounted on said second end. A sliding mount is slidably affixed to the second set of rails, and configured such that said sliding mount can be slidingly moved between the first end and the second end of the third rail.

A handle is affixed to the sliding mount, said handle having at least a first handgrip and a second handgrip, wherein each of said first handgrip and said second handgrip are configured to be grasped by one of the subject's two hands, and are interconnected The sliding mount may be configured such that force applied by one or both of a subject's hands through either of the interconnected first and second handgrips in a direction perpendicular to the first set of rails causes the sliding mount to slide along the second set of rails, and force applied by one or both of a subject's hands through either of the interconnected first and second handgrips along a direction parallel to the first set of parallel rails causes the second set of rails to slide along the first set of parallel rails.

In an embodiment of the apparatus, the second set of rails consists of a single rail.

The base may include a chest support affixed thereto and positioned such that when one or both of a subject's hands are positioned on the first and second handgrips, the subject's chest is positioned against the chest support.

The chest support may be configured and positioned such that when a subject's chest is positioned against the chest support, the first set of parallel rails are substantially parallel to the subject's chest.

In an embodiment, the handle has at least a first arm support and a second arm support affixed thereto, each of said first and second arm supports positioned between the handle and the chest support, and each comprising a support surface configured to provide support to at least a portion of one of the subject's arms between wrist and elbow, when the subject's chest is positioned against the chest support and the subject's hand is positioned about the first handgrip or the second handgrip.

In one embodiment of the apparatus, each of the first handgrip and the second handgrip comprises a tapering cone shape having a base that is wider than its vertex. The diameter of the vertex of each of the first handgrip and the second handgrip is between 10 mm and 70 mm; The diameter of the base of each handgrip may be between 20 mm and 120 mm.

In an embodiment of the apparatus, the upper surface of the base of said apparatus includes one or more grooves sized to accommodate a corresponding interfacing element of the handle. The corresponding interfacing element of the handle may comprise one or more of interfacing tabs or interface wheels sized to be accommodated within said one or more grooves.

Each rail comprising the first set of parallel rails may be between 500 mm and 1500 mm in length, and each rail within the second set of rails is between 300 mm and 1000 mm in length.

In an embodiment, the distance between the interconnected first handgrip and second handgrip is between 350 mm and 550 mm.

The base of the apparatus may be configured to be adjustably inclined at any angle between 0° and 90° relative to a horizontal plane.

In an embodiment, the grooved upper surface of the base is a removeable upper surface.

The apparatus may include one or more sensors configured to detect position or motion of the handle and a visual display interface configured to provide through a visual display one or more of visual or audio-visual cues indicating desired motions of the handle and visual or audio visual cues corresponding to the subject's compliance with the indicated desired motions of the handle.

The apparatus may further include a processor configured for receiving data from the one or more sensors and to implement data analytics for any one or more of quantifying progress, tracking or quantifying movement or movement patterns of the handle, track a subject's adherence to directions for movement and implementing interactive games for therapy and adherence to therapy In an embodiment, the apparatus may include a processor configured for implementing an artificial intelligence based model for interacting with a subject and for providing audio-visual feedback, encouragement or criticism based on received sensor inputs.

One or more of the sensors within the apparatus may be configured for measuring pulling force, pushing force, rotation, angular motion, velocity, acceleration, force or pressure of grip or pinch, and physiological parameters of the subject.

One or more of the sensors may in an embodiment be disposed within the handle of the apparatus, or within one or both of the first and second handgrips.

BRIEF DESCRIPTION OF THE ACCOMPANYING DRAWINGS

DETAILED DESCRIPTION

The present invention relies on recent discoveries that by exercising a paralyzed/semi-paralyzed limb simultaneously with the unaffected limb offers multiple advantage by promoting muscle activity in the paralyzed limb, and enhancing bilateral relearning and remodeling of neural pathways—which advances intralimb and interlimb coordination, as well as independent activity of the paralyzed limb.

The present invention comprises a bilateral arm exerciser that offers an intensive, engaging home or hospital/clinic based therapy for patients with upper extremity impairments, such as hemiparesis, hemiplegia, ataxia etc., and in cases where the upper extremity needs to enable a diverse range of motion based exercises. The apparatus is in some embodiment configured to quantify movement, tracking of sessions and motivating a subject, while strengthening muscles, improving coordination and also motivating the subject towards voluntarily increasing repetitions—towards enhanced neurological and physiological recovery.

Additional features and advantages of the invention will be set forth in the description which follows, and in part will be obvious from the description, or may be learned by the practice of the invention. These and other features of the present invention will become more fully apparent from the following description, or may be learned by the practice of the invention as set forth hereinafter.

FIGS. 1 and 8 to 15 illustrate various embodiments of the bilateral arm exerciser 100.

Figure 1:
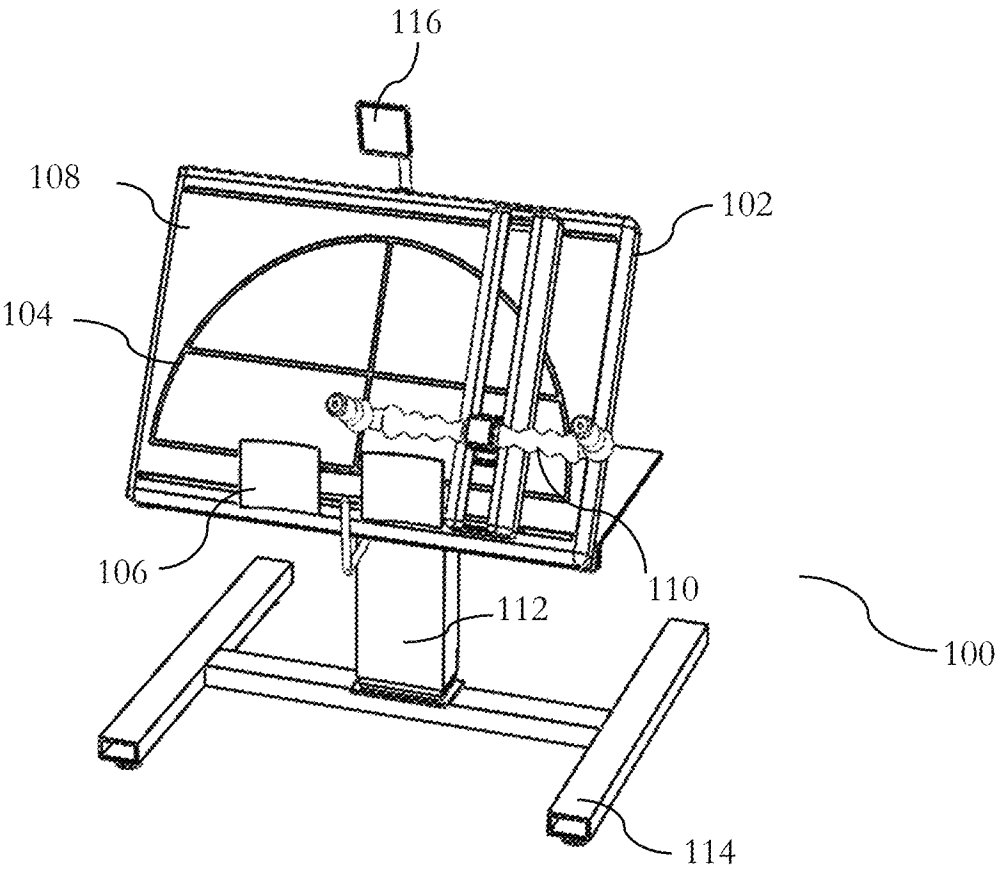
FIGS. 1 and 8 to 15 illustrate embodiment of the bilateral arm exerciser.

The embodiment of the bilateral arm exerciser 100 illustrated in FIG. 1 comprises a base 102 having one or more grooves 104 or sliding tracks provided on an upper surface 108 of the base 102 and a chest support 106 that protrudes from the base 102 in a direction proximal to the position at which a subject operating the bilateral arm exerciser 100 would be seated. The bilateral arm exerciser 100 additionally includes at least one handle 110 which is configured such that a part or component of said handle 110 may be seated within said grooves 104 or sliding tracks, and to be slidably movable within or along said grooves 104 or sliding tracks. Once seated in the grooves/tracks 104, the handle 110 may be gripped by a subject and moved along the grooves/sliding tracks 104 provided within the base. The grooves 104 or sliding tracks within the base 102 may be designed so as to ensure that in sliding the handle along the grooves 104, the subject's arm(s) that grip the handle are moved through a desired range of motions.

Figure 16A:
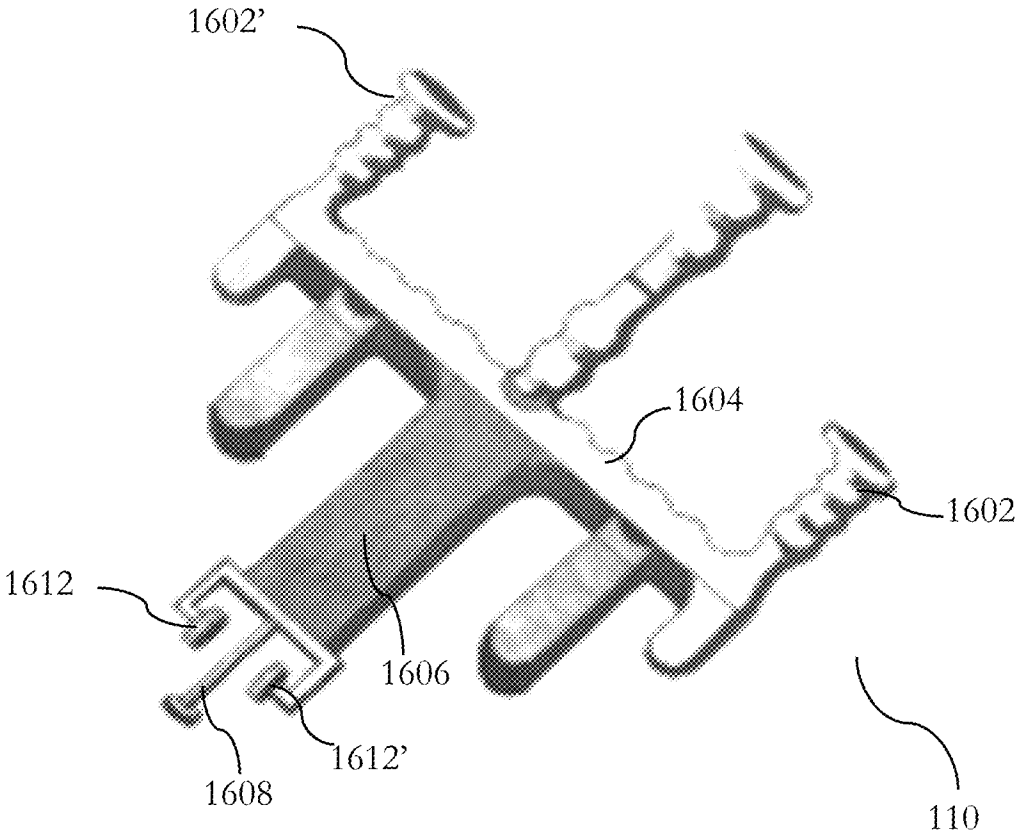
FIGS. 16A and 16B illustrate components of the bilateral arm exerciser.

FIG. 16A illustrates an exemplary embodiment of handle 110 of the bilateral arm exerciser 100—comprising at least two handgrips 1602 and 1602', a yoke 1604 connecting said two handgrips 1602 and 1602', a vertical support strut 1606, and at least one interface protrusion 1608 (for example one or more interfacing tabs or interface wheels) that enable vertical support strut 1606 to be seated within one or more grooves/sliding tracks 104 of base 102. In the embodiment, illustrated in FIG. 16A, yoke 1604 may include a third central handgrip 1614 that may be grasped by one or both of the subject's hands. It would be understood that in other embodiments, the at least two interconnected handgrips can also be horizontally positioned handgrips—for example, handgrips of the type illustrated in FIGS. 17A, 17D and FIGS. 20A to 20C.

In an embodiment of the invention, illustrated in FIG. 16A, handle 110 may be configured such that each of the two handgrips 1602, 1602' and optionally third central handgrip 1614 is a vertical or substantially vertical shaft-like handgrip. Handgrips 1602, 1602' and 1614 may in certain embodiments be configured that when handle 110 is affixed to base 102, said handgrips are substantially normal to base 102 or to upper surface 108 of base 102, or said handgrips are angled at an incline with respect to base 102 or upper surface 108. In an embodiment, the two handgrips 1602, 1602' are connected by yoke 1604, and are spaced between 350 mm and 550 mm apart from each other, more preferably between 400 mm and 500 mm apart from each other, and most preferably 450 mm apart from each other. It has been found that spacing the two handgrips 1602, 1602' in this manner provides the most significant benefits of bilateral arm exercise to a paretic or paralyzed limb.

In a further embodiment, one or more, and preferably all of of handgrips 1602, 1602', 1614 comprises a tapering cone shape, wherein the base of each handgrip is wider that the top of each handgrip and (i) the diameter of the top of each handgrip is between 10 mm and 70 mm and (ii) the diameter of the bottom of each handgrip is between 20 mm and 120 mm.

In certain embodiments, each of handgrips 1602, 1602' are provided with grooves/finger depressions to separate the subject's fingers from each other, which has been found to reduce increased muscle tone/spasticity.

In particular embodiments, the handle is configured such that when each of a subject's hands respectively grasp each of handgrips 1602, 1602', the subject's forearms or wrists rest on or in in arm supports 118. Arm supports 118 may comprise one or more supporting surfaces affixed to handle 110 such that said arm supports protrude away from handle 110 and in the direction of chest support 106. Said supporting surfaces may be positioned and shaped such when a subject's hand grasps (or is placed on) either one of handgrips 1602, 1602', at least a portion of the grasping arm (between the elbow and wrist of the arm) rests on or is supported by an arm support 118.

Figure 16B:
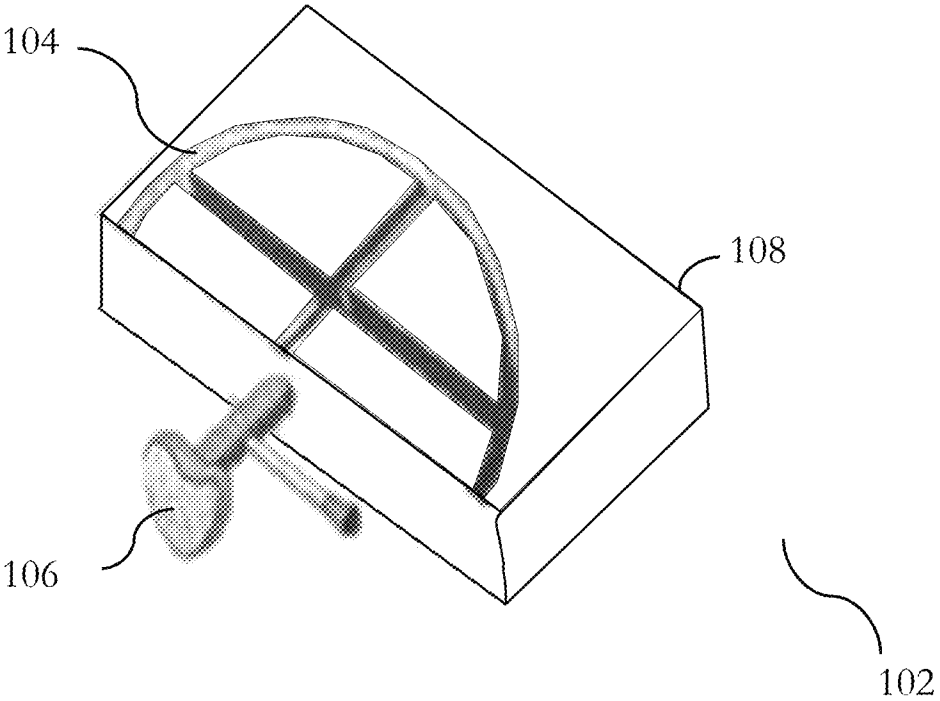

FIG. 16B illustrates an enlarged view of base 102 of the bilateral arm exerciser 100—comprising upper surface 108, grooves/sliding tracks 104 formed on said upper surface 109 and chest support 106.

Figure 16C:
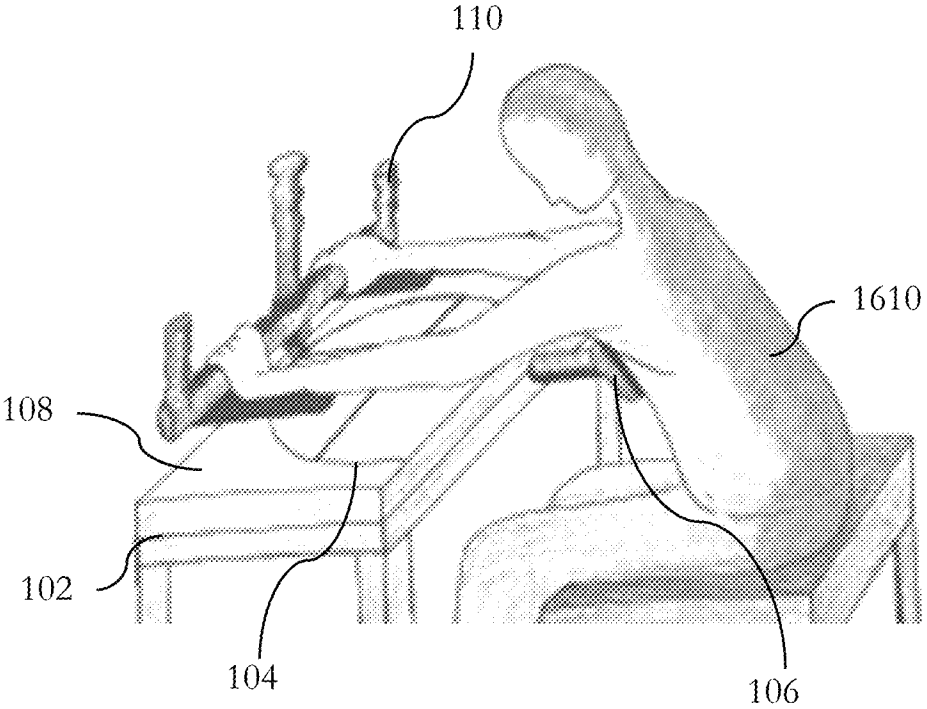
FIG. 16C illustrates an intended use of the bilateral arm exerciser.
Figure 17A:
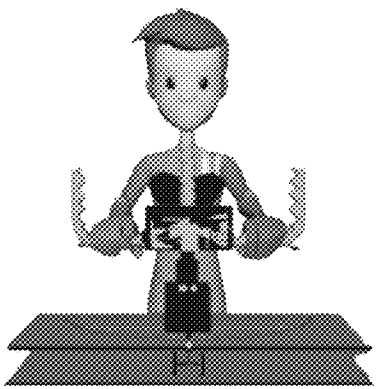
FIGS. 17A to 17F illustrates a variety of grips that a subject may use to operate the bilateral arm exerciser.
Figure 17B:
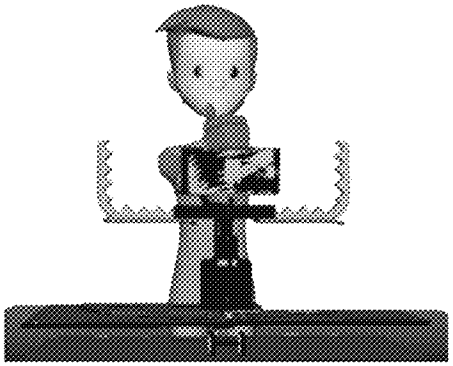
Figure 17C:
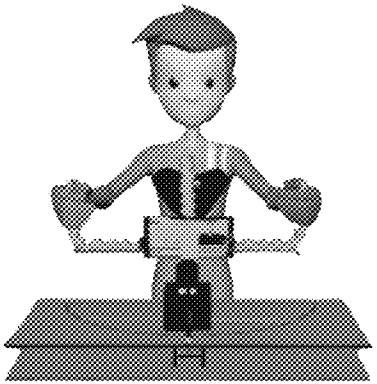
Figure 17D:
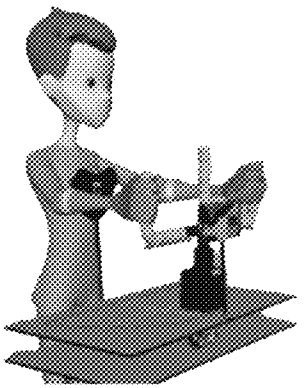
Figure 17E:
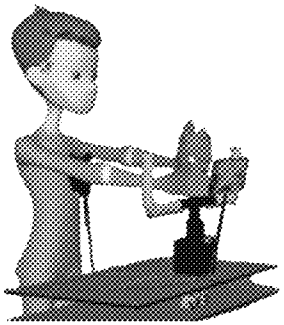
Figure 17F:
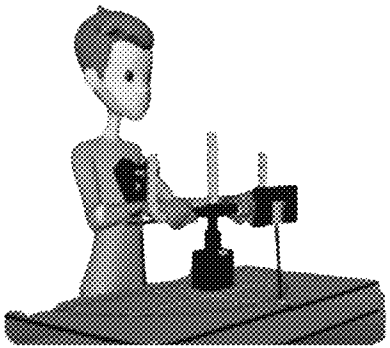
Figure 18A:
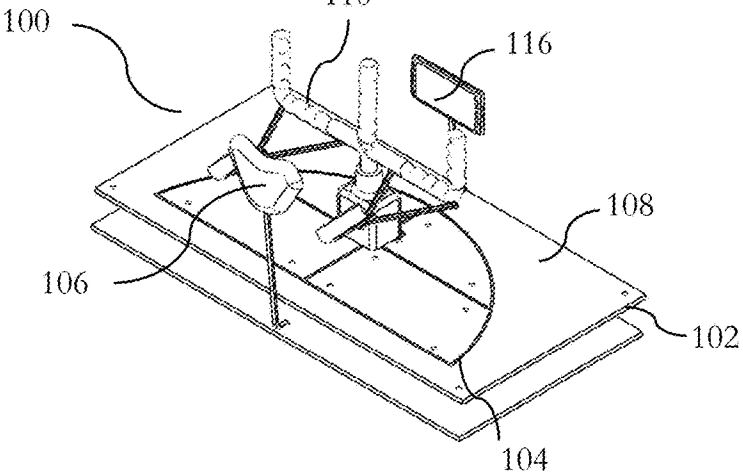
FIGS. 18A to 18D and 19A to 19F illustrate a range of motions through which the bilateral arm exerciser may be operated.
Figure 18B:
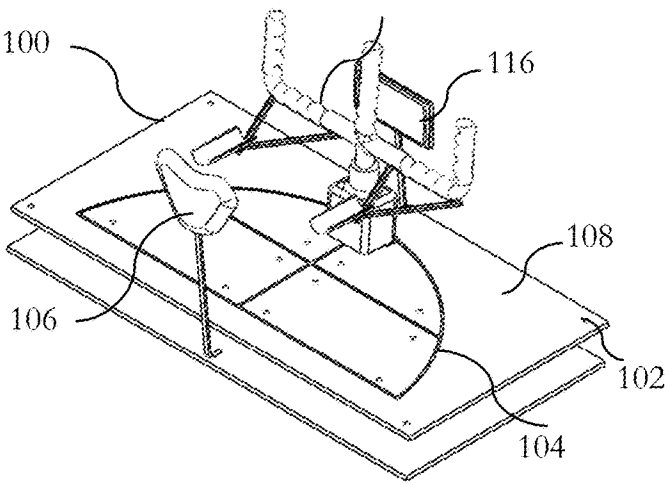
Figure 18C:
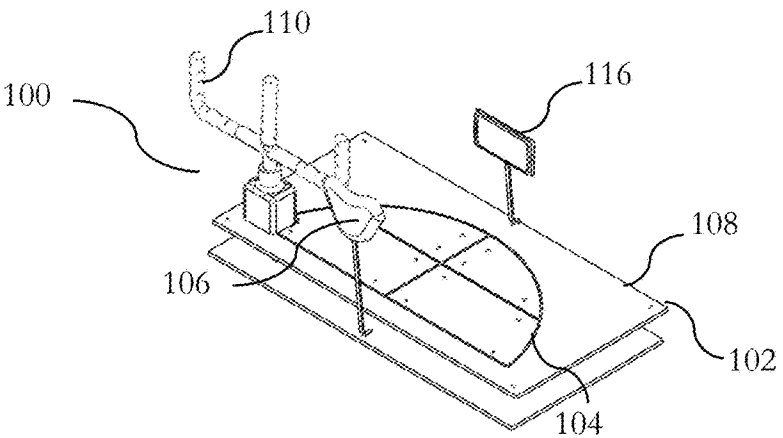
Figure 18D:
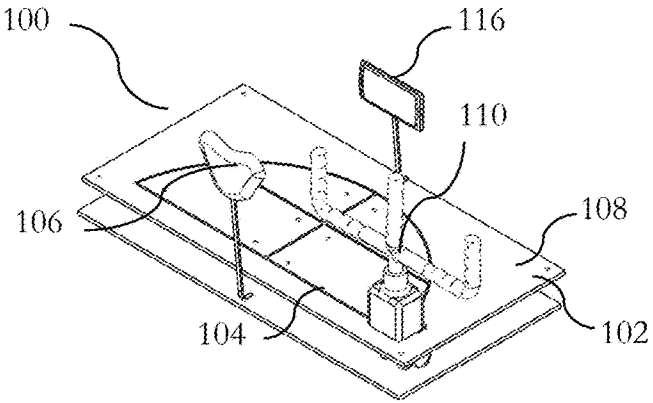
Figure 19A:
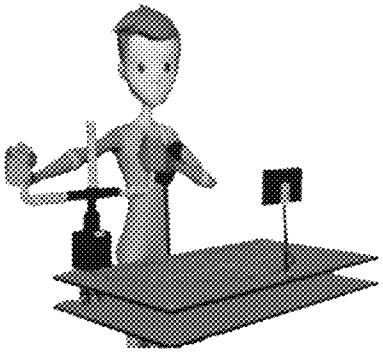
Figure 19B:
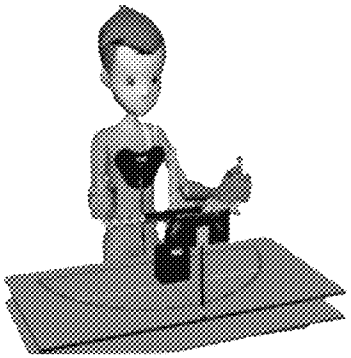
Figure 19C:
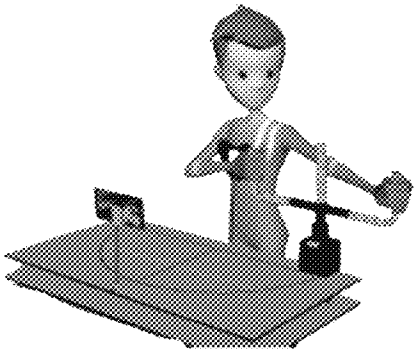
Figure 19D:
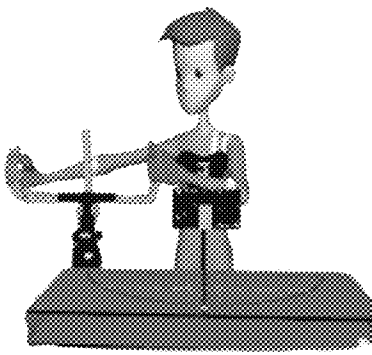
Figure 19E:
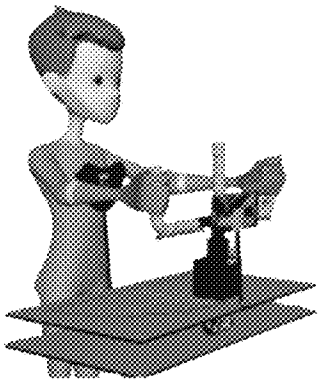
Figure 19F:
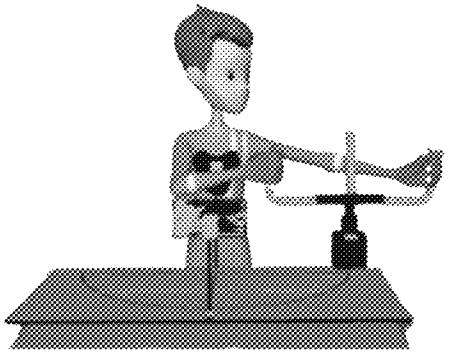

FIG. 16C illustrates a subject 1610 seated for the purpose of using the bilateral arm exerciser 100, in front of base 102, with the chest support 106 positioned against the subject's 1602 chest, and wherein both the subject's hands are positioned on handle 110 and the subject is using both arms to move the handle 110 along the grooves 104 provided in the upper surface 108 of the base of the bilateral arm exerciser (for example base 102 illustrated in FIG. 1).

It would be understood that the chest support 106 shown in any of the accompanying figures may be formed to conform to the human anatomy in the chest region, and may in certain embodiments also include one or more straps or harnesses to strap a user's torso to the chest support—which provides additional support for users who are suffering from paralysis or partial paralysis. In an embodiment of bilateral arm exerciser 100, chest support 106 may be positioned such that when a subject's chest is supported by said chest support. 106, the x-axis rails of positioning mechanism 200 are substantially parallel to the subject's chest.

The handle(s) 110 and groove(s) 104 or tracks are respectively configured so that the handle 110 faces minimum resistance in sliding within the grooves 104 or along the tracks. In an embodiment (for example the embodiment shown in FIG. 16A), the handle(s) may achieve low resistance through the use of rollers, wheels 1612, 1612' or other devices for minimizing friction or resistance. In other embodiments, weights or resistance may be added to oppose the handle movement along the tracks, for strength building or for facilitating relearning.

Figure 12:
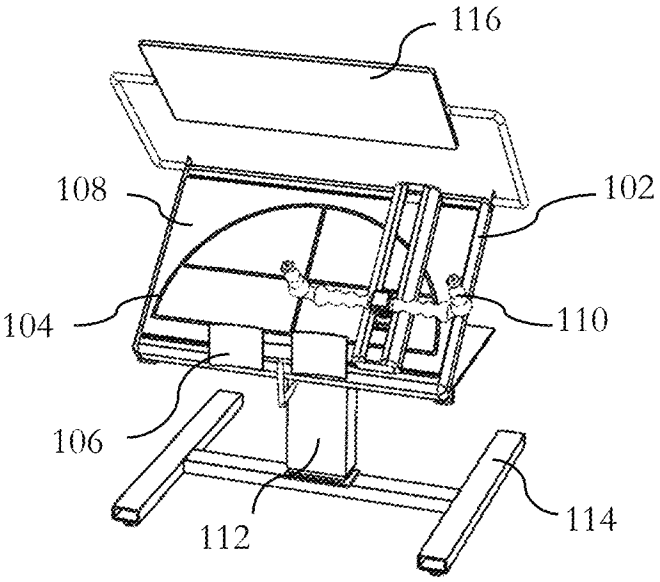
Figure 13:
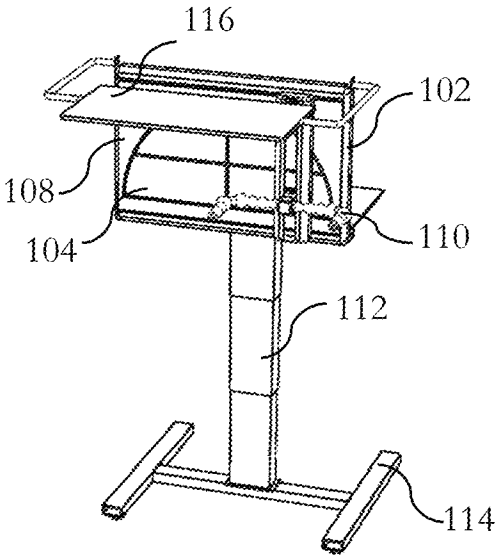
Figure 14:
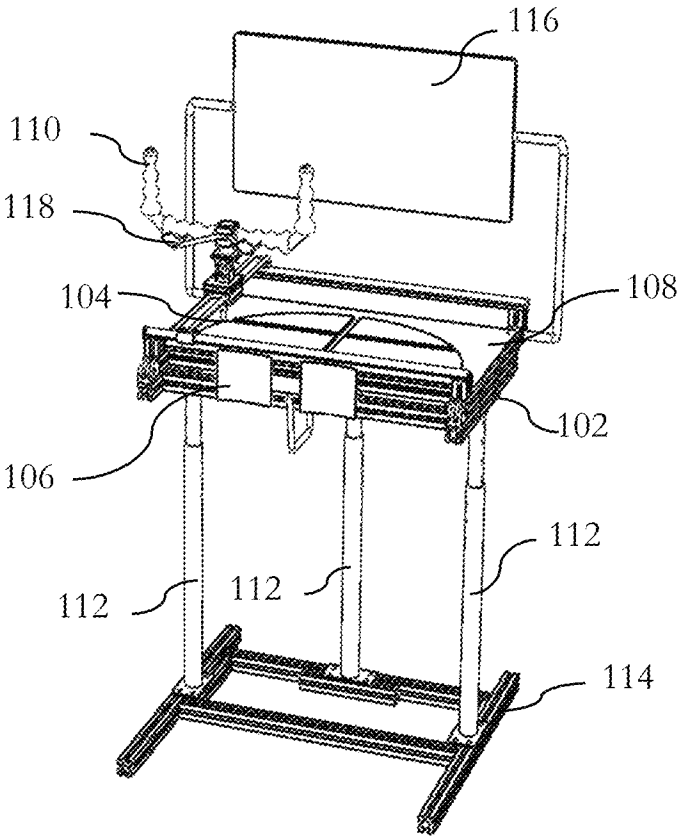
Figure 15:
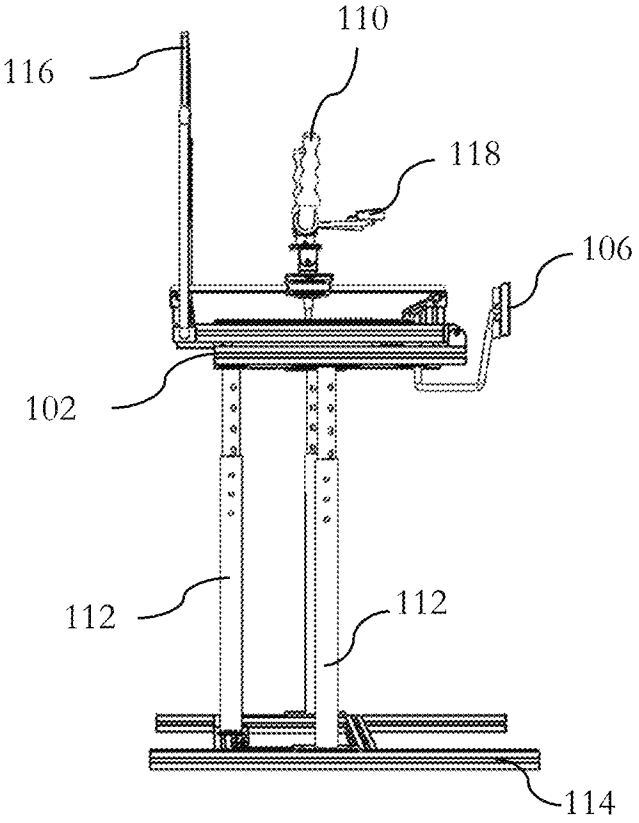

In a particular embodiment (for example, the embodiment shown in FIG. 1) the base 102 may comprise an inclinable surface, so that the base can be pivotably inclined at any one of a range of angles with respect to the horizontal plane, thereby providing the subject with a variety of different ranges of motion through which the handle(s) require to be moved. FIGS. 8, 9, 11, 14 and 15 illustrate embodiments of the bilateral arm exerciser 100 where base 102 is positioned horizontally. FIGS. 1, 10 and 12 illustrate embodiments of the bilateral arm exerciser 100 where base 102 is positioned at an angle of incline between the horizontal and vertical positions). FIG. 13 illustrates an embodiment of the bilateral arm exerciser 100 where base 102 is positioned vertically. It would be understood that the configurations taught by this invention would enable base 102 to be positioned at any at an angle or incline of between 0° and 90° with respect to a horizontal plane.

In a specific embodiment of the bilateral arm exerciser 100, the grooved or tracked upper surface 108 of the base 102 may comprise a removable surface, thereby facilitating modular removal and replacement of groove or track patterns on the base 102.

In various embodiments, base 102 of bilateral arm exerciser 100 may be affixed on one or more than one vertical support(s) 112 affixed to stand 114 such that bilateral arm exerciser 100 is a freestanding apparatus. In an embodiment of the invention, the one or more vertical support(s) 112 comprises one or more telescoping or expanding or lengthening supports that enable the height of base 102 to be adjusted. In an embodiment, the one or more vertical support(s) 112 can be configured to enable the height of base 102 to be fixed at any height between 400 mm and 1600 mm from the ground—resulting in a user being able to use the bilateral arm exerciser 100 to be used in either of a seated or standing position. The bilateral arm exerciser may be configured such that base 102 is capable of being detached and placed on a wall at a height comfortable for being operated by a user from a standing position.

As shown in FIGS. 1 and 8 to 15, the bilateral arm exerciser 100 may include a visual display 116 (which in the illustrated embodiment may be a mobile phone or mobile computing device or tablet or a HMD (head mounted display)) positioned such that a subject seated to operate the bilateral arm exerciser would be able to see the visual display 116. In an embodiment of the invention, the visual display 116 may be connected to a processor configured to provide on the visual display 116, visual cues, audio-visual cues and/or other feedback directing the desired motion to be executed by the subject using the bilateral arm exerciser 100. In an embodiment, the visual display 116 or the processor may additionally be communicatively coupled to one or more sensors capable of detecting the actual position or motion of the handle 110. In a particular embodiment the sensors may be configured to track whether the subject is following the visual cues being shown on the visual display 116, and whether the handle 110 is being moved through the correct ranges of motion that are shown on the visual display 116. In a specific embodiment, the processor or associated software may be configured to implement a video game/computer game/game based challenge, by providing the subject with visual cues (on the visual display 116) on the desired range of motions for the handle 110, monitoring the actual movements of the handle 110, and determining whether the subject has complied with the visual cues. In an embodiment, the visual display 116 may display appropriate predefined alerts or game based responses based on whether the subject is able to execute the desired range of motions or not. In an embodiment, the software or game based application may implement one or more of virtual reality, augmented reality or mixed reality displays and user interfaces.

In an embodiment, the processor may be communicatively coupled to any sensor capable of detecting motion, including accelerometers, gyroscopes, contact based sensors, photodetectors, capacitive sensors, pressure based sensors, infrared sensors etc.

In an embodiment of the invention, the processor or controller is provided with software that uses data analytics to quantify progress, track/quantify movement/movement patterns, track adherence and sessions and provide interactive games for therapy.

In a specific embodiment, the processor may be configured to implement a software interface enabling a therapist to set goals and exercises for the subject, depending on the subject's current progress. The subject would be able to view the goals set by the therapist and also look at the improvement of her/his performance.

In certain embodiments of the invention, the processor may be configured to implement an artificial intelligence model based assistance which interacts with the user/patient and provides audio-visual feedback/encouragement/criticism based on received sensor inputs from the bilateral arm exerciser 100 and an analysis of the user/patient's performance on the bilateral arm exerciser 100 based on an analysis of said received sensor inputs.

FIGS. 17A to 17F illustrate a variety of grips that a subject may use to hold the illustrated handle 110 of the bilateral arm exerciser 100 and move it along the grooves or tracks 104 on upper surface of base 102. It would be understood that each grip offers different stimulus to both the subject's muscles and neural pathways. By providing for a variety of potential grips or holds, the handle(s) 102 of the bilateral arm exerciser 100 offers for a faster physiological and neurological relearning and a shorter recovery time. In an embodiment, the one or more handle (s) 110 may have specific shapes designed to improve a specific motor skill (e.g. a knob shape to improve grasping and turning, or a key share to improve twisting). In a specific embodiment, a handle 110 may include an inflatable sock connected to an air pump to accurately simulate open-close movement of a grasping action.

FIGS. 18A to 18D illustrate a range of positions through which the handle 110 of bilateral arm exerciser 100 may be moved along the segmented D shaped track 104 provided on the upper surface 108 of base 102. It would be understood that these range of positions may be changed by changing the groove or track pattern 104 on upper surface 108 of base 102.

FIG. 19A to 19F illustrate a subject moving the handle 110 through the range of possible positions through which the handle 110 may be moved along the segmented D shaped track 104 provided on an upper surface 108 of base 102 Once again, it would be understood that the range of possible positions can be changed by changing the groove or track pattern 104 on the upper surface 108 of base 102.

Figure 20A:
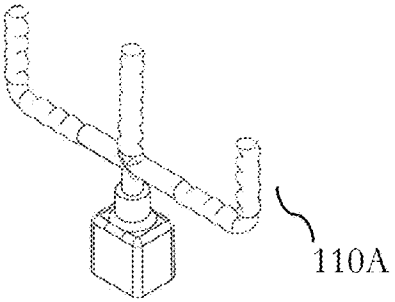
FIGS. 20A to 20F and 21A to 21C illustrate a variety of handle types that may be implemented in apparatuses in accordance with a first embodiment of the invention.
Figure 20B:
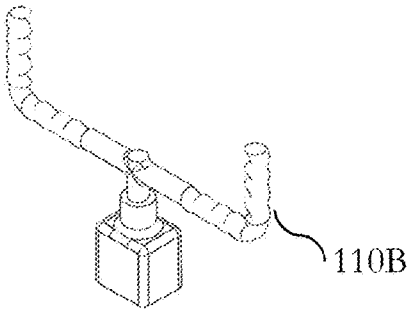
Figure 20C:
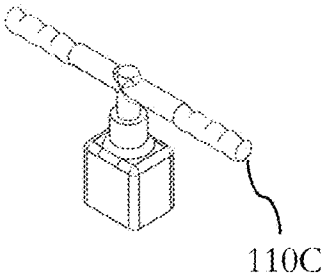
Figure 20D:
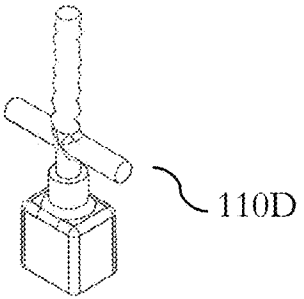
Figure 20E:
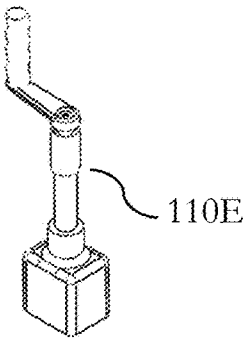
Figure 20F:
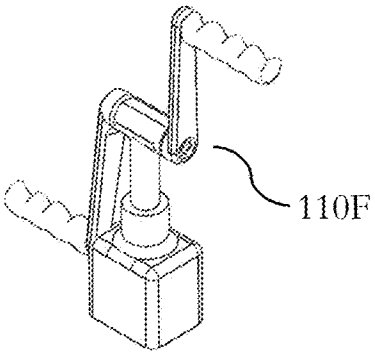

FIGS. 20A to 20F illustrate a variety of handles 110A to 110F that may be implemented in accordance with the teachings of the present invention. While FIGS. 20A. 20B, 20C and 20F illustrate handles 110A, HOB, HOC and 110F designed for two handed operation, FIGS. 20D and 20E illustrate handles HOD and 110E designed for one handed operation. It would be understood that in cases where the subject is using handles designed for one handed operation, two such handles may be affixed onto the base, so that the subject can operate both handles—one to each hand. While the handles 11 OA to HOD shown in FIGS. 20A to 20D facilitate typical pulling or pushing actions by the subject and flexion or extension of limbs or joints, the handles 110E and 110F shown in FIGS. 6E and 6F facilitate rotational movements by the subject's hands, in addition to pulling, pushing, flexion or extension motions and a combination of movements which add to patterns such as reaching etc.

Figure 21C:
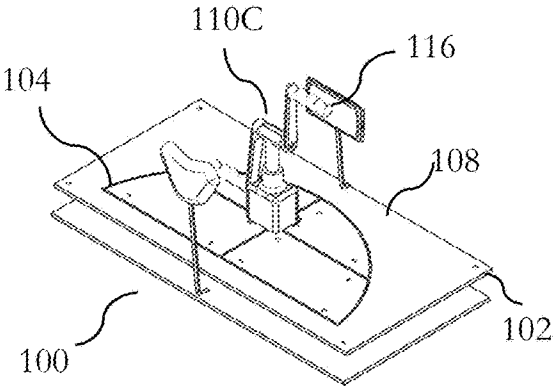
Figure 21B:
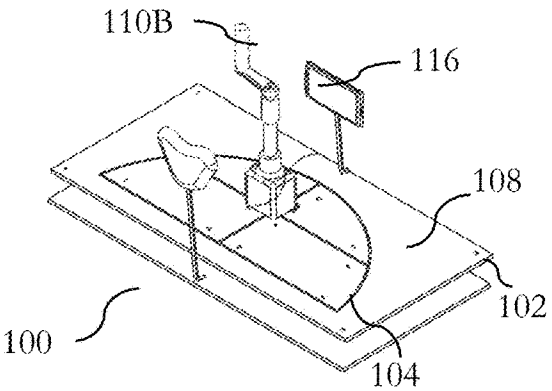
Figure 21A:
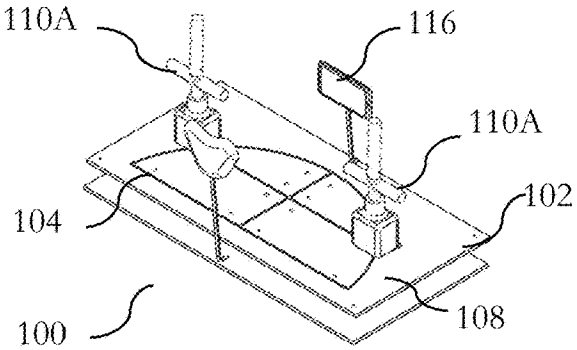

FIG. 21A illustrates an embodiment of bilateral arm exerciser 100, where two handles 11 OA and 110B are affixed to base 102—one for each hand of the subject. FIGS. 21B and 21C illustrate embodiments where the handle HOB, HOC affixed to the base 102 facilitates rotational movements as well as pulling and pushing motions, by the subject's hands. In one of the two-handled embodiments of the invention, a first handle 110A grasped by or supporting the paretic limb may be controlled by a guide or control mechanism to replicate or mirror the position or motion of the second handle HOA' that is grasped by or supporting the healthy limb of the subject. This embodiment allows a subject to carry out particular motions or actions on the second handle 11 OA' with a healthy limb, while the paretic limb is guided through the same motion or action or through a mirrored motion or action by the first handle 110 that is grasped by or that supports the paretic limb.

In an embodiment of the bilateral arm exerciser, the one or more handles 110 may have one or more arm supports 118 positioned such that when gripping handles 110, the subject's wrists or forearms can rest against arm supports 118—thereby reducing arm fatigue and enable the subject to exercise more control over bilateral arm exerciser 100. The one or more handles are interchangeable, and may include one or more sensors capable of measuring pulling force, pushing force, rotation, angular motion, velocity, acceleration, force or pressure of grip or pinch, physiological parameters such as heart rate, galvanic skin response etc.

Figure 2:
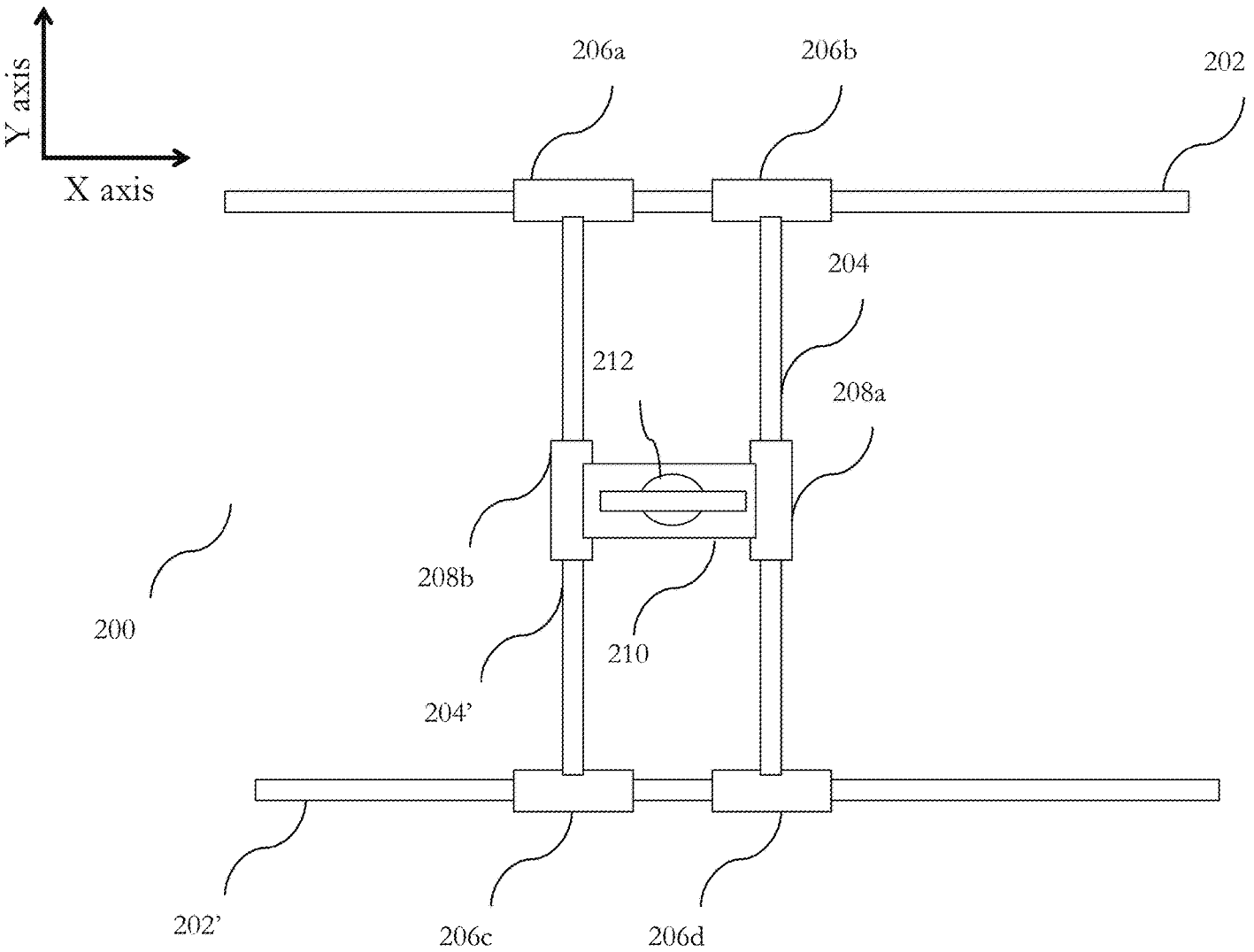
FIGS. 2 to 7 illustrate the positioning mechanism for the bilateral arm exerciser.

FIG. 2 illustrates a positioning mechanism 200 for the bilateral arm exerciser 100 which may be used for guiding or supporting the one or more handles 110 along with/instead of the groove or track arrangement 104 disclosed above. The positioning mechanism 200 illustrated in FIG. 2 comprises a movable assembly comprising a pair of x-axis aligned rails 202, 202' positioned parallel to each other, and a pair of y-axis aligned rails 204, 204' positioned parallel to each other. Both the y-axis rails 204, 204' are slidably mounted on each of the x-axis aligned rails 202, 202' by means of a plurality of linear motion bearings/bushings (e.g. linear slides) 206*a*, 206*b*, 206*c* and 206*d*. The plurality of linear motion bearings/bushings 206*a* to 206*d* enable y-axis aligned rails 204, 204' to be moved along the x-axis rails along the x-axis direction.

Y-axis aligned rails 204, 204' are interconnected by a rigid yoke or interconnector 210, having handle 212 mounted thereon. Yoke or interconnector 210 is slidably mounted on each of the y-axis aligned rails 204, 204' by means of linear motion bearings/bushings (e.g. linear slides) 208*a*, 208*b*. Said linear motion bearings/bushings 208*a* and 208*b* enable yoke 210 to be moved along the y-axis rails along the y-axis direction.

By virtue of the combination of x-axis aligned rails and y-axis aligned rails and linear motion bearings 206*a* to 206*d* and 208*a* and 208*b*, a subject may by grasping handle 212 and applying pushing or pulling force to said handle 212, maneuver said handle to any desired position in the x-y plane defined by the length x-axis rails 202, 202' and the width separating said x-axis rails 202, 202' from each other.

Figure 3:
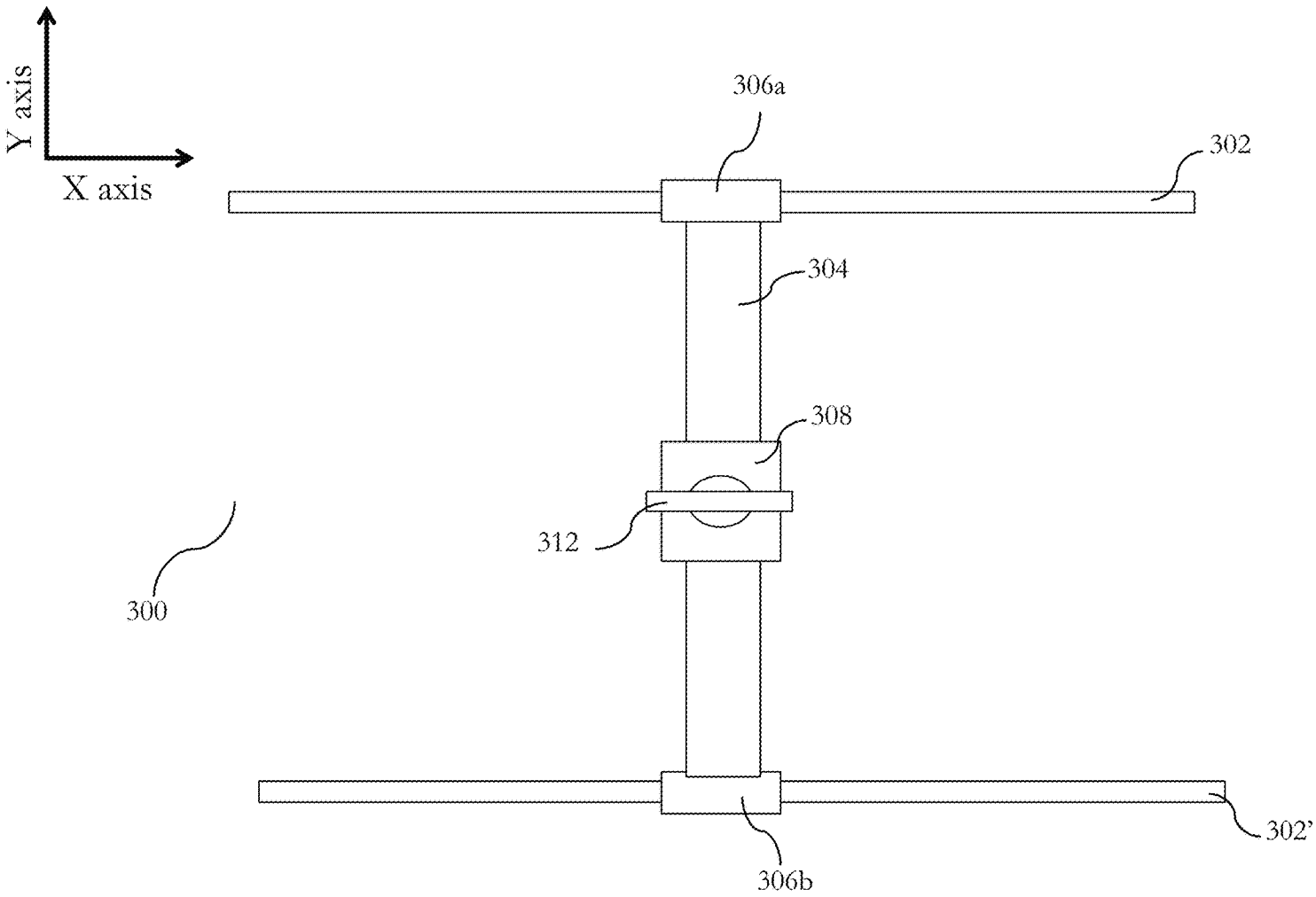

FIG. 3 illustrates an alternate embodiment 300 for the positioning mechanism more generally discussed in connection with FIG. 2—wherein the positioning mechanism 300 comprises only a single Y-axis aligned rail 304 (in a preferred embodiment a non-cylindrical rail) slidably mounted on the two x-axis aligned rails 302 and 302'. In this embodiment the handle 312 is slidably mounted (through slidable mount 308) on the single Y-axis aligned rail 304, thereby enabling the handle 312 to be moved along the single y-axis rail along the y-axis direction.

Figure 4:
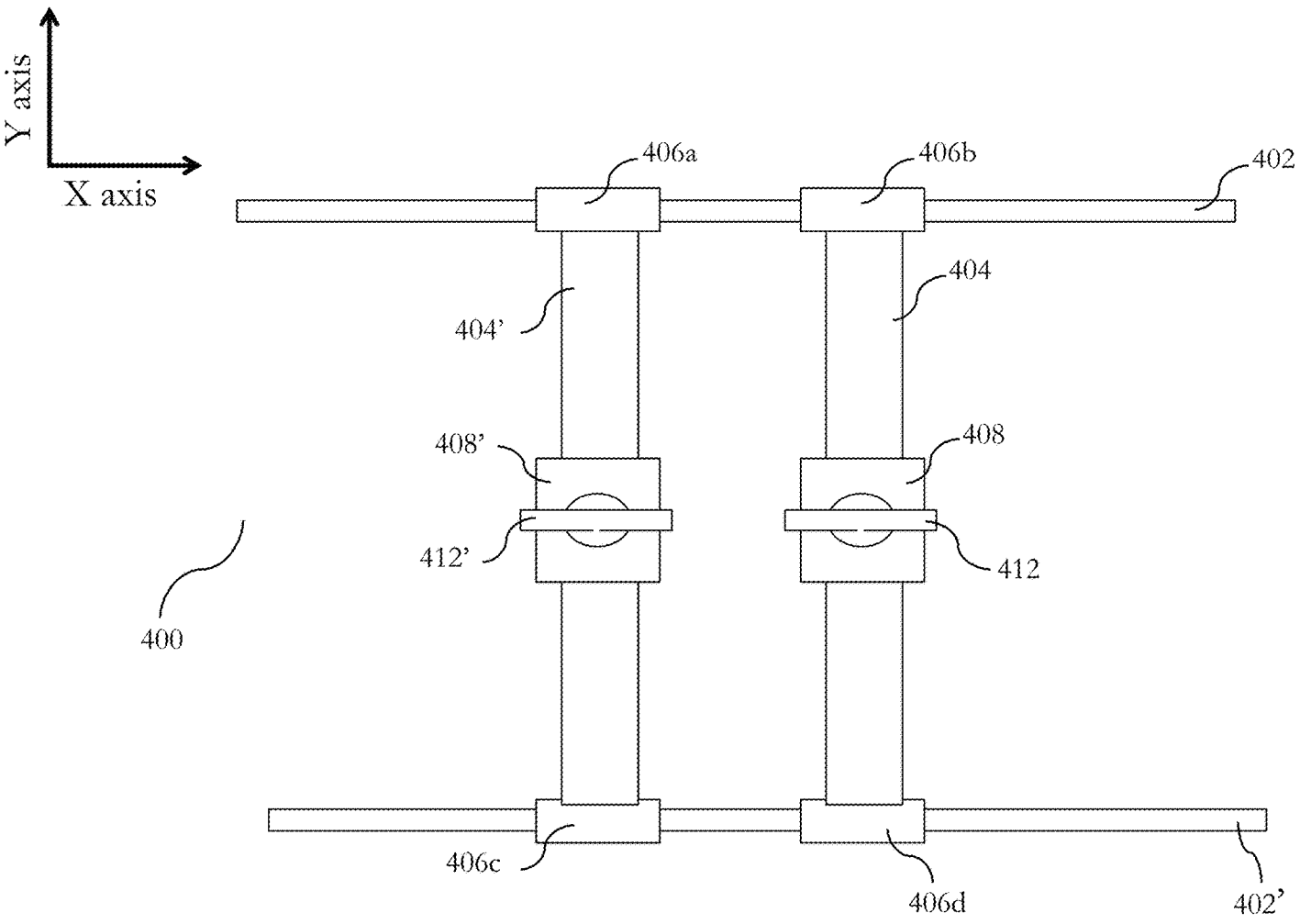

FIG. 4 illustrates another embodiment 400 for the positioning mechanism—wherein the positioning mechanism 400 comprises two independent Y-axis aligned rails 404, 404' (preferably non-cylindrical rails), each slidably mounted on the two x-axis aligned rails 402, 402'—by means of slide bearings 406*a* to 406*d*. In this embodiment an independent handle 412, 412' is slidably mounted (through slidable mounts 408, 408') on each of the single Y-axis aligned rails 404, 404', thereby enabling the two handles 412, 412' to be moved along their corresponding y-axis rails 404, 404' along the y-axis direction—and for each handle 412, 412' to be moved anywhere in the x-y plane, independent of the other.

Figure 5:
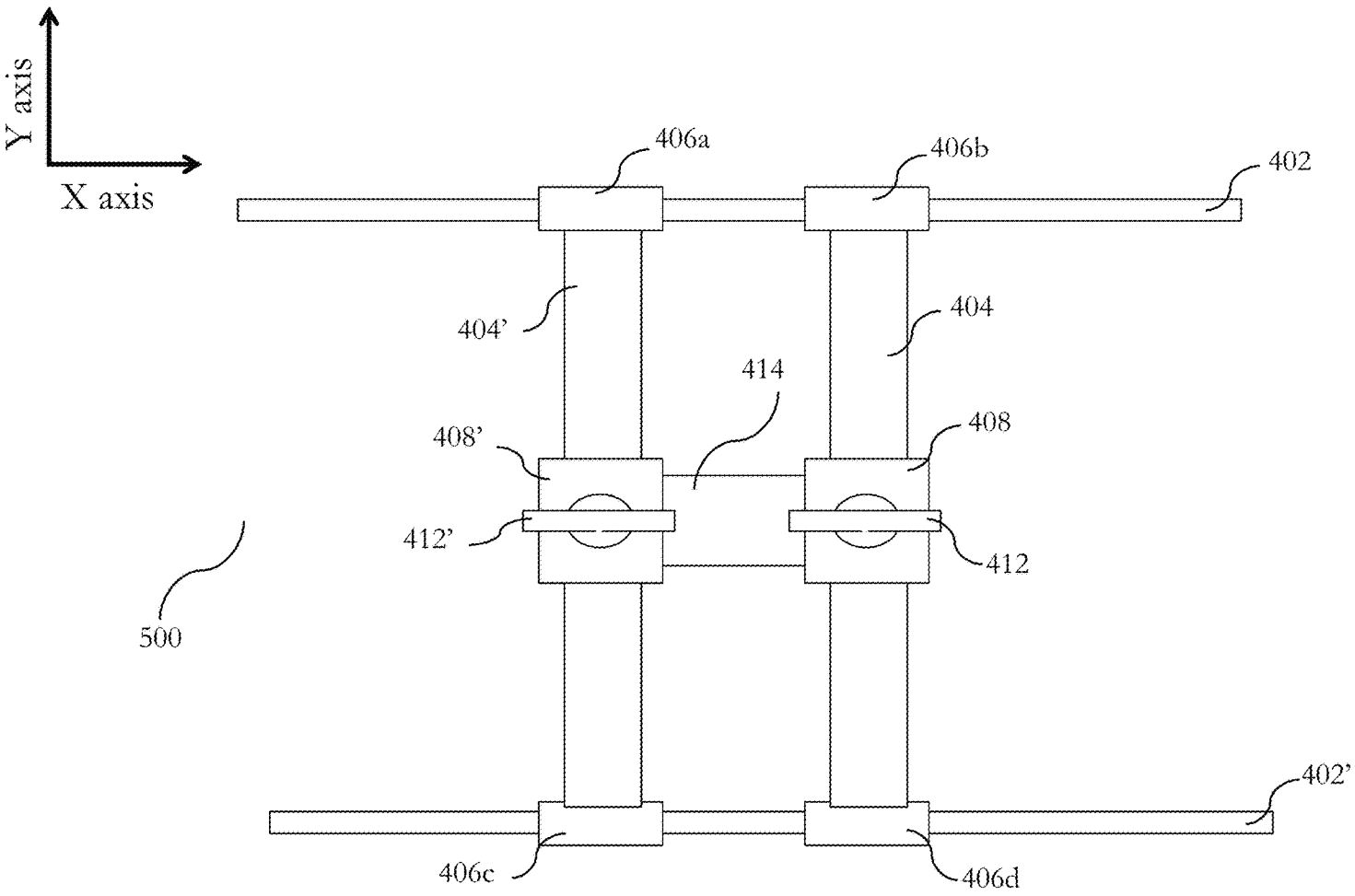

FIG. 5 illustrates a more specific embodiment 500 of the embodiment 400 illustrated in FIG. 4, wherein the two handles 412, 412' (and slidable mounts 408, 408') are interconnected by a flexible or elastic connector 414. Accordingly, while the two handles 408, 408' can be moved anywhere in the x-y plane, independent of the other, selection of appropriate material for the flexible or elastic connector 414 ensures generation of resistance as the two handles 412, 412' are moved away from each other—thereby increasing the intensity of the exercise.

Figure 6:
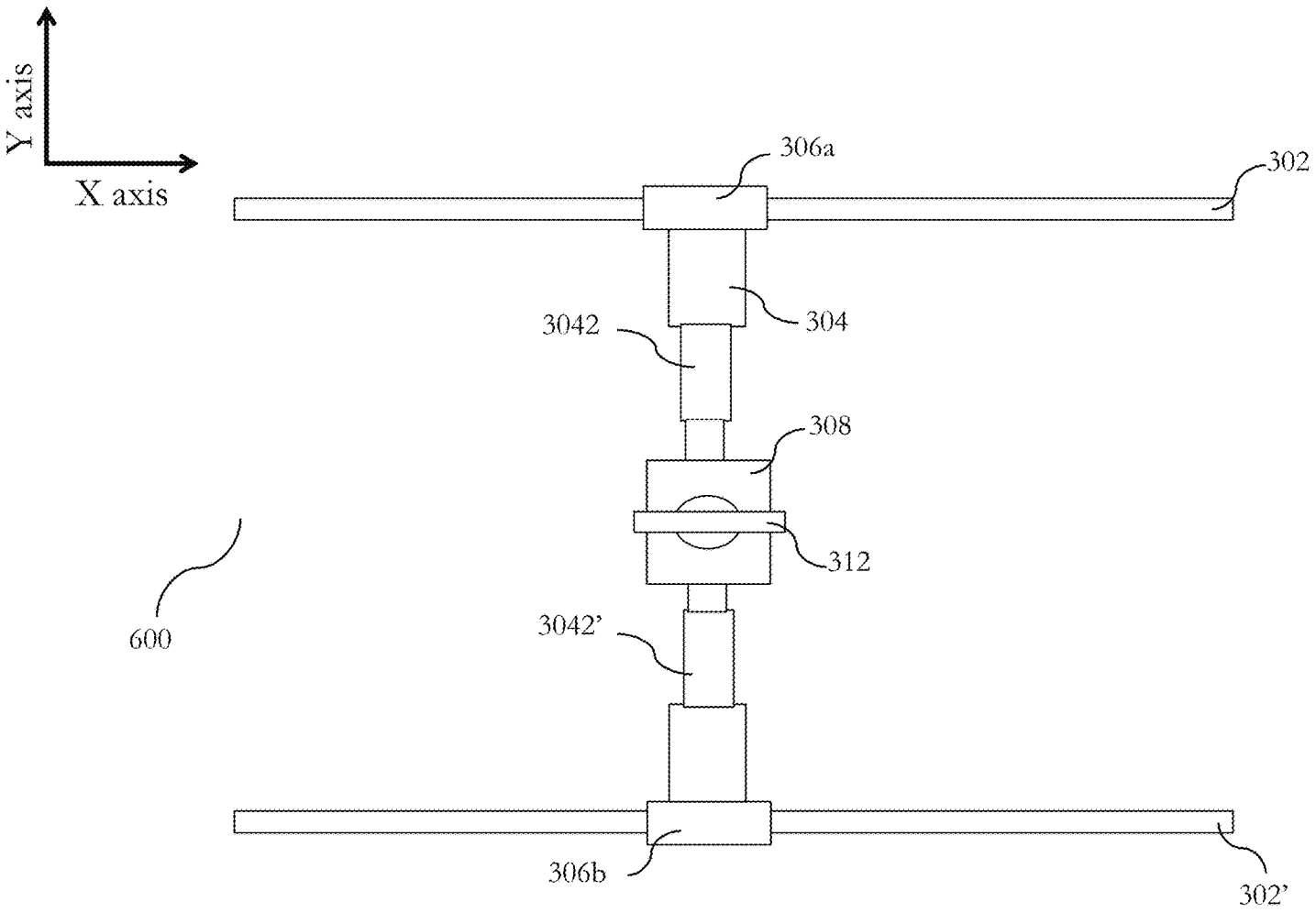

FIG. 6 illustrates an alternate embodiment 600 for the positioning mechanism more generally discussed in connection with FIG. 3—wherein the positioning mechanism comprises only a single Y-axis aligned rail slidably mounted on the two x-axis aligned rails 302, 302'. In this embodiment the y-axis aligned rail 304 comprises two telescopic rails 3042 and 3042', wherein one end of each of the two telescopic rails 3042, 3042' are slidably mounted on one of the two x-axis aligned rails 302, 302', and the other end of each of the two telescopic rails 3042 and 3042' is coupled with the handle 312 through handle mount 308—thereby enabling the handle 312 to be moved along the y-axis direction by reciprocating telescoping action of the two telescopic rails 3042, 3042', and therefore for the handle 312 to be moved anywhere in the x-y plane.

Figure 7:
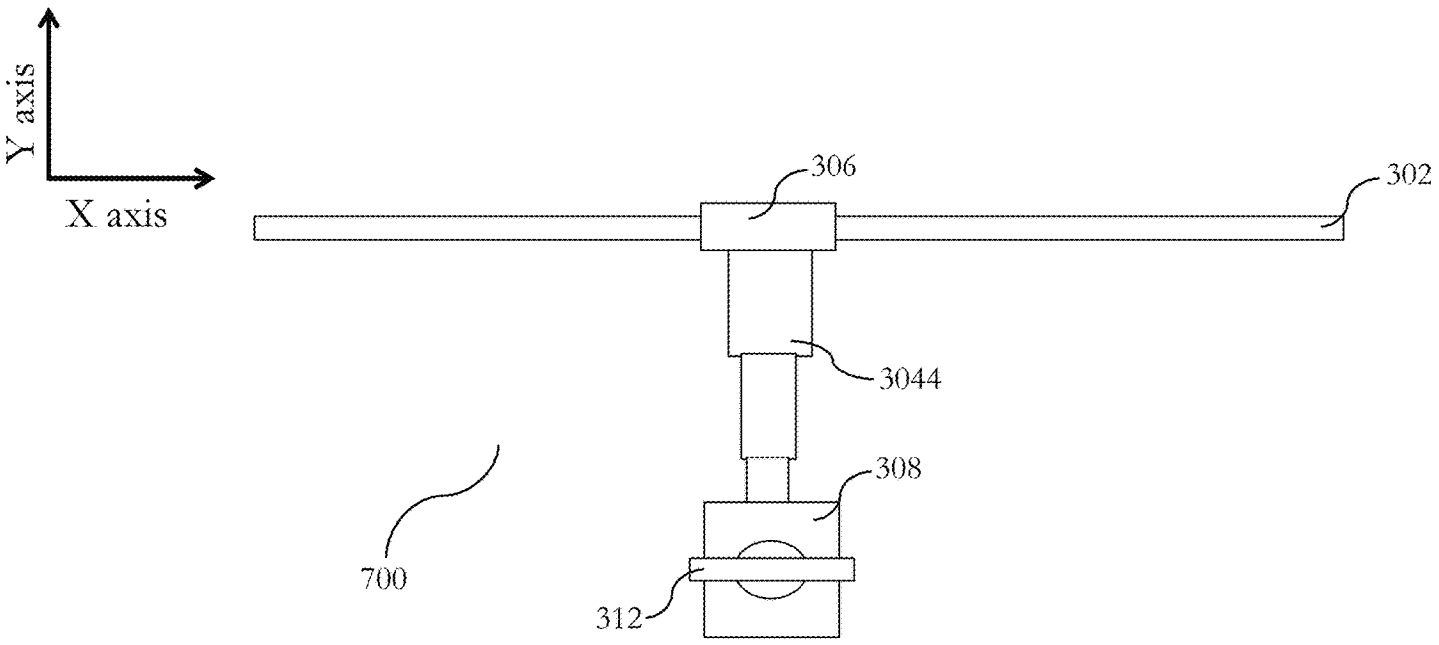
Figure 8:
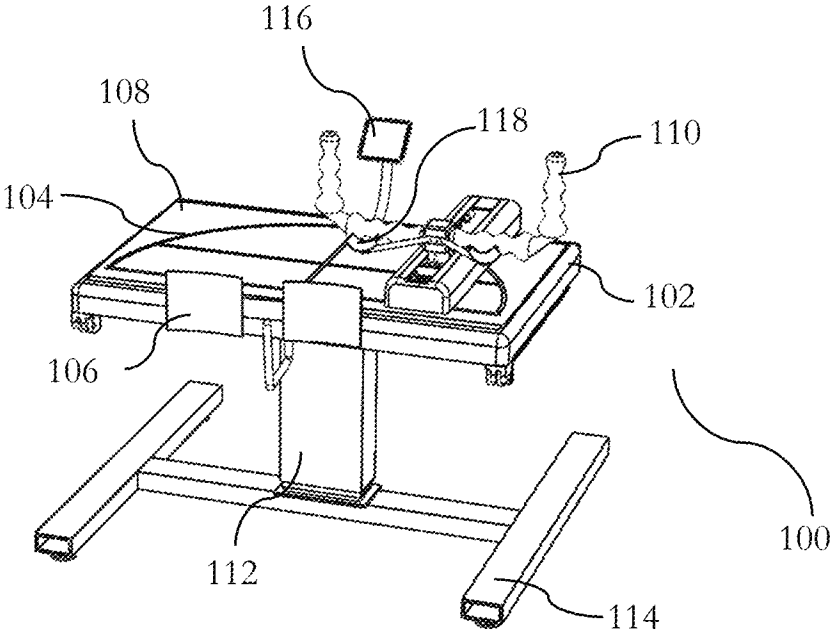

FIG. 7 illustrates another embodiment 700 for the positioning mechanism more generally discussed in connection with FIG. 6—wherein the positioning mechanism 700 comprises only a single Y-axis aligned rail 3044 slidably mounted on a single x-axis aligned rail 302 through slidable mount 306. In this embodiment, the y-axis aligned rail 3044 comprises a single telescopic rail, wherein one end of the telescopic rail is slidably mounted on the x-axis aligned rail 302, and the other end of the telescopic rail T1 is coupled with the handle mount 308 and to handle 312 that is mounted thereon—thereby enabling the handle 312 to be moved along the y-axis direction by telescoping action of the telescopic rail 3044—and anywhere in the x-y plane defined by the length of the x-axis aligned rail 302, and by the maximum length of telescopic rail 3044. While FIG. 7 illustrates a telescopic y-axis aligned rail 3044, it would be understood that the single telescoping rail 3044 that is slidably mounted on a single x-axis aligned rail 302, may be replaced with a single non-cylindrical y-axis aligned rail 3044 of the type discussed in connection with FIG. 3, which may be slidably mounted on the single x-axis aligned rail 302, and with the handle 312 being slidably mounted on said single y-axis aligned rail 3044. This arrangement would also allow the handle 312 to be moved in the y-axis direction along the length of the single y-axis aligned rail 3044, and therefore anywhere in the x-y plane defined by the length of the x-axis aligned rail 302 and the length of the y-axis aligned rail 3044. In this arrangement, but not shown in the figure, it can be understood that two such individual arrangements can be used independently for each hand.

In preferred embodiments of the positioning mechanisms illustrated if FIGS. 2 to 7, (i) the length of the horizontal rail(s)/x-axis aligned rail(s) is between 500 mm and 1500 mm, and (ii) the length of the vertical rail(s)/y-axis aligned rail(s) is between 300 mm and 1000 mm—which have been found to provide optimum dimensions for bilateral arm exercise of paralyzed or paretic limbs.

It has been found that in embodiments of the positioning mechanism illustrated in FIGS. 2 to 7, mounting of x-axis aligned rails to slide on y-axis rails (wherein said x-axis aligned rails and y-axis aligned rails are within the preferred dimension ranges recited in the preceding paragraph) results in developing of torque when the handle mounted on the positioning mechanism is at or near the y-axis rails—which interferes with smooth movement of the handle. This problem has been surprisingly addressed by mounting of the y-axis rails to slide on the x-axis rails instead.

It will be observed that each of the bilateral arm exerciser illustrations in FIGS. 1 and 8 to 15 show an embodiment of the invention that implements a positioning mechanism of the type illustrated in one of FIGS. 2 to 7.

The bilateral arm exercise apparatus illustrated in FIGS. 1 and 8 to 15 may additionally comprises a lower support frame and an upper frame configured to enable mounting of the positioning mechanism thereon. The lower support frame and the upper frame may be connected using one or more hinges, to enable the upper frame to be pivotably inclined with respect to the lower support frame and/or a horizontal plane. Either or both of the lower support frame and the upper support frame may be provided with support spars to affix the upper frame at the desired angle of inclination. The x-axis guide rails of the positioning mechanism may be mounted on the upper frame with sufficient space between the upper frame and the x-axis aligned guide rails and between the upper frame and the y-axis aligned guide rails to ensure that (i) y-axis aligned rails can be freely moved along the x-axis rails along the x-axis direction and (ii) a yoke or slidable mount for a handle can be freely moved along the y-axis rails along the y-axis direction.

Figure 9:
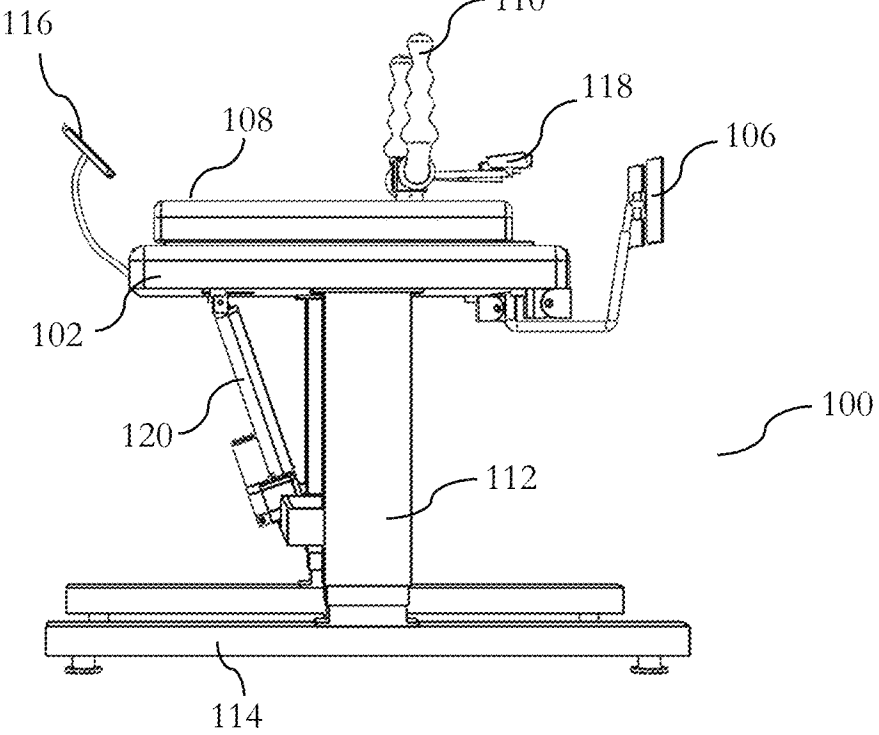
Figure 10:
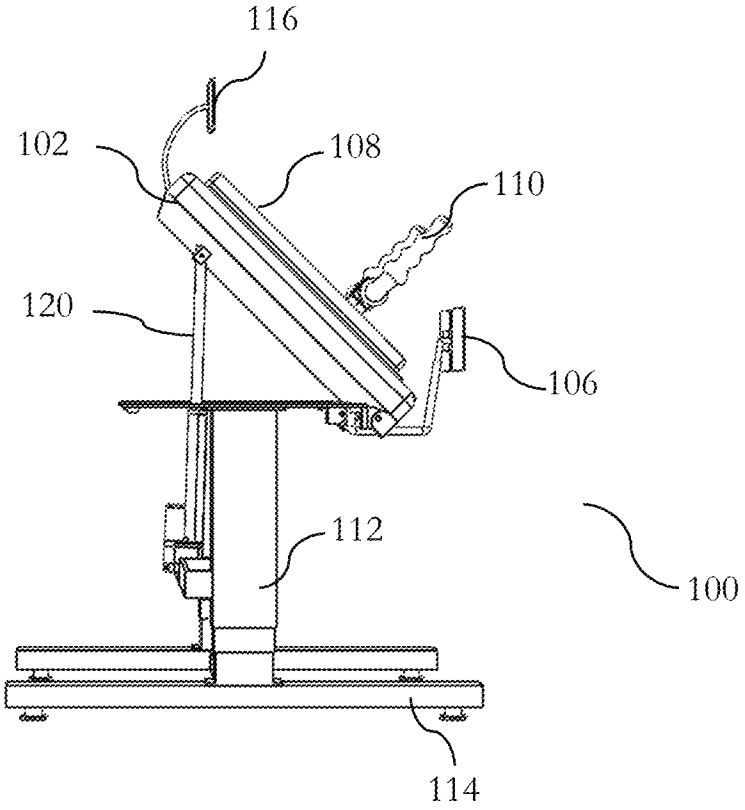
Figure 11:
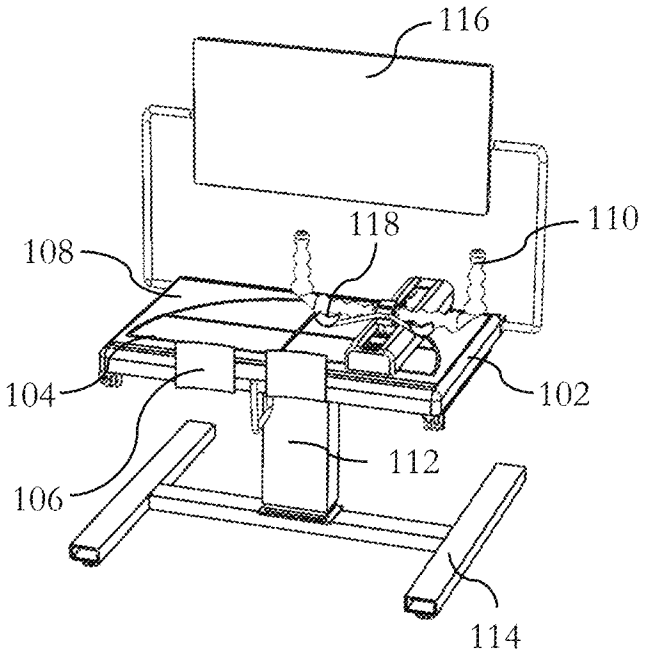

Particularly in the embodiments illustrated by side views of the bilateral arm exerciser 100 in FIGS. 9 and 10, it will be observed that said bilateral arm exerciser 100 may include an actuatable support spar 120 that can be used to move base 102 from a horizontal position to an inclined position (or to a fully vertical position). In various embodiments support spar 120 may comprise a pneumatically, electrically or otherwise actuatable support spar that can move base 102 through a variety of inclination angles relative to a horizontal plane.

In an embodiment of the invention, the upper frame comprises an upper surface which upper surface is provided with a set of grooves or channels and the handle may be configured such that a lower end of said handle engages with said grooves or channels. In this embodiment, the subject would perforce move the handle through a range of positions in the x-y plane that are dictated by the grooves or channels. In an embodiment, the grooved or tracked surface of the base may comprise a removable surface, thereby facilitating modular removal and replacement of groove or track patterns on the base.

In one embodiment, the handle may comprise an adjustable depth handle, wherein the lower end of said handle is capable of being raised or lowered. When the lower end of said handle is raised (or for that matter is pre-sized) so that it does not touch or engage with a surface of the upper frame or with any grooves or tracks laid out on the upper frame, in which case, the subject no longer benefits from the guidance of the tracks or grooves for moving the handle in the desired movement pattern, and is instead solely reliant on motor skills for following a pattern laid out on the upper frame or as required by the game/visual display.

In an embodiment, the grooves provided on an upper surface of the base of the bilateral arm exerciser are of a depth and width between 2 mm and 30 mm.

As in the case of the earlier discussed embodiments, the subject may be guided in her/his movements or may receive feedback in connection with her/his movements from a visual display or an audio-visual display in accordance with the invention embodiments discussed above. It will be understood that all embodiments relating to visual displays, processors, software, games, sensors, communication of feedback to the subject, and data analytics that have been described in connection with the previous embodiments are equally intended to be implemented in connection with the invention embodiments illustrated in FIGS. 2 to 7.

In a particular embodiment of the invention, the bilateral arm exerciser 100 may include a processor, a network communication interface and a transceiver, wherein the processor is configured to enable set up of an network communication based audiovisual session with one or more remote client terminals. By implementing this feature, a subject using the device can be monitored or watched by a health care provider or personal trainer who is located remotely, and said subject and health care provider/personal trainer can interact and work jointly towards achieving the subject's physiotherapy goals. The apparatus may also be configured to communicate to said remote client terminal data obtained from one or more sensors within the apparatus- to enable the health care provider/personal trainer to assess the subject's performance and state of health and/or recovery. It would be understood that by implementing this embodiment, the bilateral arm exerciser enables a remotely located health care provider/personal trainer to plan the rehabilitation process, set therapy parameters and goals, monitor performance data, visualize physiotherapy process and analyze recovery, provide insights and help patient recovery, provide feedback, counsel, inspire and motivate patients and provide remote interventions. The apparatus may additionally be configured to communicate with a remote server, which remote server may serve as a repository of patient health data and parameter data received from the apparatus, analyze and track goals and progress of a subject, periodically send the subject information relevant to her/his progress and health, and send reminders/updated physiotherapy goals to the subject.

In operating the device, a patient with upper extremity motor impairment may begin using the device in bilateral mode—i.e. with both hands. This enables motion of the impaired arm with support of the healthy arm. The patient would be performing therapeutic exercises in accordance to the game. Each session is summarized with a quantitative summary, and also the data is pushed to a server for the therapist to visualize. Resistance to the movements may be added from time to time to the movement of the handle(s) increase the intensity of the therapy. Over time, as the impaired arm begins to recover some motor function, the patient may use it in unilateral mode—i.e. using only the affected arm. As the limb recovers, the therapy in unilateral mode may be taken a step further by adding resistance to the movements—the overall objective being to increase the number of repetitions to, enable new neural connections, strengthen the muscles, and thereby enhance recovery.

Figure 22:
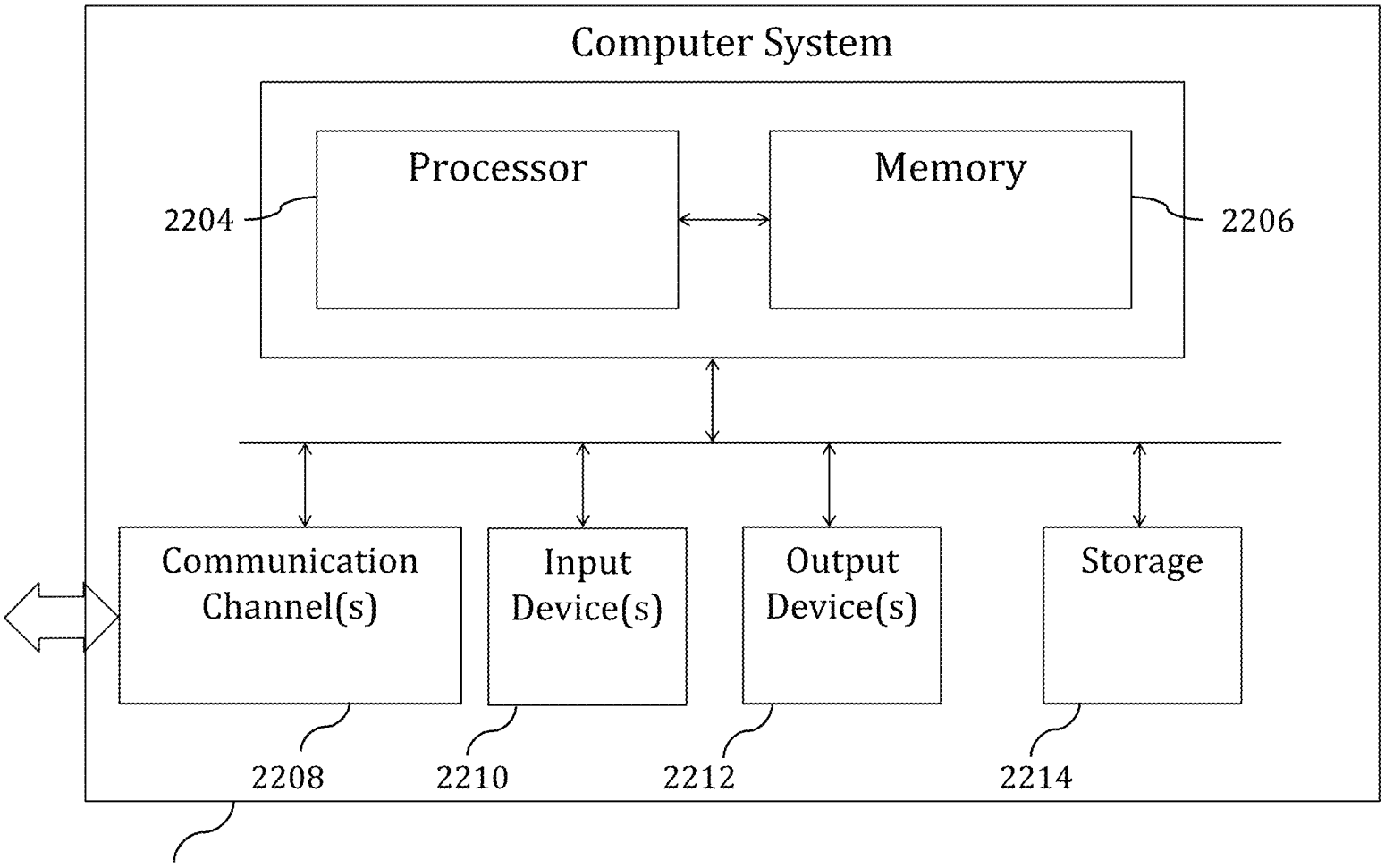
FIG. 22 illustrates an exemplary computer system configured to implement one or more embodiments of the present invention.

By virtue of implementing the above embodiments, the invention provides a device capable of enabling a subject to develop and hone motor skills along all 3 axes, and to continuously challenge the subject by providing for easy modification or changes to the patterns of motion that a subject is required to follow. Additionally, the invention provides a low cost, portable solution that is capable of being used by a subject at home or in a hospital or clinic, and which advances both physiological and neurological relearning of the subject. Specific advantages of the device include:

- providing an intensive, engaging home/clinic/hospital based therapy device for patients with upper extremity impairments, such as hemiparesis, hemiplegia, ataxia etc., and in cases where the upper extremity needs range of motion exercises.
- the device along with the corresponding software enable quantification of movements, tracking of sessions and improvements.
- the device provides visual, haptic, auditory feedback based on the subject's detected movements and is made engaging and motivating by incorporating game play.
- the device helps strengthen muscles and improve coordination, while the increased repetitions enable faster neurological recovery.
- additionally information/signals received from one or more sensors provided in the bilateral arm exerciser provides:
  - data that describes adherence and compliance to therapy
  - data describing overall time of therapy
  - data describing duration of active sessions and break time
  - data quantifying movement (e.g. total distance moved)
  - data representing patterns of movement
  - data representing a number of clinically relevant movements (flexion, extension, adduction, abduction, circumduction, pronation, supination etc.)
  - data representing difficulty or resistance
  - data representing incline levels
  - data representing grip strength
  - data representing improvement trends (or deterioration)
  - data representing engagement of the patient in therapy
  - data representing movement patterns for diagnosis of certain conditions (e.g. by evaluation of velocity, acceleration, etc.)
  - data representing movement patterns for analyzing improvement
  - data representing/suggesting areas of weakness which need further improvement
  - Spatio-temporal data that can be further analyzed
  - data representative of physiological patterns like galvanic skin response and/or heart rate for analysis of stress
  - data representative of physiological patterns like galvanic skin response and heart rate for analysis of emotional patterns
- the software based algorithms implemented to in connection with the bilateral arm exerciser of the present invention can be configured to adjust maximum length to be moved in the game by the patient/user.
- the software may be configured for adaptive gaming according to performance of patient based on different algorithms based on Artificial Intelligence
- implementation of the chest support feature additionally prevents unwanted/i compensatory movements
  - prevents the subject from leaning on one side/the weaker side
  - ensures that the subject's back remains straight FIG. 22 illustrates an exemplary computer system 2202 for implementing the present invention.

The illustrated system comprises computer system 2202 which in turn comprises one or more processors 2204 and at least one memory 2206. Processor 2204 is configured to execute program instructions—and may be a real processor or a virtual processor. It will be understood that computer system 2202 does not suggest any limitation as to scope of use or functionality of described embodiments. The computer system 2202 may include, but is not be limited to, one or more of a general-purpose computer, a programmed microprocessor, a micro-controller, an integrated circuit, and other devices or arrangements of devices that are capable of implementing the steps that constitute the method of the present invention. Exemplary embodiments of a computer system 2202 in accordance with the present invention may include one or more servers, desktops, laptops, tablets, smart phones, mobile phones, mobile communication devices, tablets, phablets and personal digital assistants. In an embodiment of the present invention, the memory 2206 may store software for implementing various embodiments of the present invention. The computer system 2202 may have additional components. For example, the computer system 2202 may include one or more communication channels 2208, one or more input devices 2210, one or more output devices 2212, and storage 2214. An interconnection mechanism (not shown) such as a bus, controller, or network, interconnects the components of the computer system 2202. In various embodiments of the present invention, operating system software (not shown) provides an operating environment for various softwares executing in the computer system 2202 using a processor 2204, and manages different functionalities of the components of the computer system 2202.

The communication channel(s) 2208 allow communication over a communication medium to various other computing entities. The communication medium provides information such as program instructions, or other data in a communication media. The communication media includes, but is not limited to, wired or wireless methodologies implemented with an electrical, optical, RF, infrared, acoustic, microwave, Bluetooth or other transmission media.

The input device(s) 2210 may include, but is not limited to, a touch screen, a keyboard, mouse, pen, joystick, trackball, a voice device, a scanning device, or any another device that is capable of providing input to the computer system 2202. In an embodiment of the present invention, the input device(s) 2210 may be a sound card or similar device that accepts audio input in analog or digital form. The output device (s) 2212 may include, but not be limited to, a user interface on CRT, LCD, LED display, or any other display associated with any of servers, desktops, laptops, tablets, smart phones, mobile phones, mobile communication devices, tablets, phablets and personal digital assistants, printer, speaker, CD/DVD writer, or any other device that provides output from the computer system 2202.

The storage 2214 may include, but not be limited to, magnetic disks, magnetic tapes, CD-ROMs, CD-RWs, DVDs, any types of computer memory, magnetic stripes, smart cards, printed barcodes or any other transitory or non-transitory medium which can be used to store information and can be accessed by the computer system 2202. In various embodiments of the present invention, the storage 2214 may contain program instructions for implementing any of the described embodiments.

In an embodiment of the present invention, the computer system 2202 is part of a distributed network or a part of a set of available cloud resources.

The present invention may be implemented in numerous ways including as a system, a method, or a computer program product such as a computer readable storage medium or a computer network wherein programming instructions are communicated from a remote location.

The present invention may suitably be embodied as a computer program product for use with the computer system 2202. The method described herein is typically implemented as a computer program product, comprising a set of program instructions that is executed by the computer system 2202 or any other similar device. The set of program instructions may be a series of computer readable codes stored on a tangible medium, such as a computer readable storage medium (storage 2214), for example, diskette, CD-ROM, ROM, flash drives or hard disk, or transmittable to the computer system 2202, via a modem or other interface device, over either a tangible medium, including but not limited to optical or analogue communications channel(s) 2208. The implementation of the invention as a computer program product may be in an intangible form using wireless techniques, including but not limited to microwave, infrared, Bluetooth or other transmission techniques. These instructions can be preloaded into a system or recorded on a storage medium such as a CD-ROM, or made available for downloading over a network such as the Internet or a mobile telephone network. The series of computer readable instructions may embody all or part of the functionality previously described herein.

While the exemplary embodiments of the present invention are described and illustrated herein, it will be appreciated that they are merely illustrative. It will be understood by those skilled in the art that various modifications in form and detail may be made therein without departing from or offending the spirit and scope of the invention as defined by the appended claims. Additionally, the invention illustratively disclosed herein suitably may be practiced in the absence of any element which is not specifically disclosed herein—and in particular embodiment specifically contemplated, is intended to be practiced in the absence of any element which is not specifically disclosed herein.

What is claimed is:

1. An apparatus for arm exercise for therapy of a subject, the apparatus comprising:

a base comprising a planar upper surface;

a first set of parallel rails affixed to said upper surface of the base, the first set of parallel rails comprising a first rail and a second rail positioned parallel to each other and separated from each other by a predefined first distance; and a second set of rails comprising at least a third rail having a first end and a second end; characterized in that:

the base comprises a lower support frame and an upper frame that are pivotably interconnected through one or more hinges, and configured to enable the upper frame be pivotably moved from a horizontal position to a position that is inclined with respect to a horizontal plane;

the apparatus includes one or more sensors configured to detect position or motion of a handle, and a visual display interface, wherein the visual display interface is configured to:

display on a visual display, one or more visual cues that direct movement of the handle;

receive motion data representing movement of the handle detected by the one or more sensors; and display on the visual display a visual representation of the detected movement of the handle by the subject;

the first end of the third rail is slidably mounted on the first rail and said second end of the third rail is slidably mounted on said second rail;

a sliding mount slidably affixed to the second set of rails, and configured such that said sliding mount can be slidingly moved between the first end and the second end of the third rail;

a first handgrip and a second handgrip respectively affixed to the sliding mount, wherein said first handgrip and said second handgrip are connected to the sliding mount such that force applied to the sliding mount through the first handgrip in a direction perpendicular to the first set of parallel rails causes the second handgrip to simultaneously move in a direction perpendicular to the first set of parallel rails, and force applied to the sliding mount through the first handgrip in a direction parallel to the first set of parallel rails causes the second handgrip to simultaneously move in a direction parallel to the first set of parallel rails;

wherein the sliding mount is configured such that force applied through either of the first handgrip and the second handgrip in a direction perpendicular to the first set of parallel rails causes the sliding mount to slide along the second set of rails, and force applied through either of the first handgrip and the second handgrip along a direction parallel to the first set of parallel rails causes the second set of rails to slide along the first set of parallel rails;

and further wherein the upper surface of the base of said apparatus includes one or more grooves sized to accommodate a corresponding interfacing element of the handle;

the corresponding interfacing element of the handle comprises one or more of interfacing tabs or interface wheels sized to be accommodated within said one or more grooves; and the handle is configured such that a lower end of said handle is configured for being lowered or raised such that in a lowered position the lower end of said handle is in engagement with said one or more of grooves and in raised position the lower end of said handle does not contact said one or more grooves.

2. The apparatus as claimed in claim 1, wherein the upper frame is configured to be pivotably positioned at any angle between 0° and 90° relative to a horizontal plane.

3. The apparatus as claimed in claim 1, comprising an actuatable spar configured to move the base from a horizontal position to an inclined position.

4. The apparatus as claimed in claim 1, wherein the second set of rails consists of the third rail.

5. The apparatus as claimed in claim 1, wherein the base has a chest support affixed thereto and positioned such that when one or both of the subject's hands are positioned on the first handgrip and the second handgrip, the subject's chest is positioned against the chest support.

6. The apparatus as claimed in claim 5, wherein, the chest support is configured and positioned such that when the subject's chest is positioned against the chest support, the first set of parallel rails are substantially parallel to the subject's chest.

7. The apparatus as claimed in claim 6, wherein the handle has at least a first arm support and a second arm support affixed thereto, each of said first arm support and said second arm support is positioned between the handle and the chest support, and each comprising a support surface configured to provide support to at least a portion of one of the subject's arms between wrist and elbow, when the subject's chest is positioned against the chest support and the subject's hand is positioned about the first handgrip or the second handgrip.

8. The apparatus as claimed in claim 1, wherein;

each of the first handgrip and the second handgrip comprises a tapering cone shape having a base that is wider than its vertex;

a diameter of the vertex of each of the first handgrip and the second handgrip is between 10 mm and 70 mm; and a diameter of the base of each of the first handgrip and the second handgrip is between 20 mm and 120 mm.

9. The apparatus as claimed in claim 1, wherein each rail comprising the first set of parallel rails is between 500 mm and 1500 mm in length, and each rail within the second set of rails is between 300 mm and 1000 mm in length.

10. The apparatus as claimed in claim 9, wherein a distance between the interconnected first handgrip and second handgrip is between 350 mm and 550 mm.

11. The apparatus as claimed in claim 1, wherein the upper surface of the base is a removeable upper surface.

12. The apparatus as claimed in claim 1, comprising a processor configured for receiving data from the one or more sensors and to implement data analytics for any one or more of quantifying progress, tracking or quantifying movement or movement patterns of the handle, track the subject's adherence to directions for movement and implementing interactive games for therapy and adherence to therapy.

13. The apparatus as claimed in claim 1, comprising a processor configured for implementing an artificial intelligence based model for interacting with the subject and for providing audio-visual feedback, encouragement or criticism based on received sensor inputs.

14. The apparatus as claimed in claim 1, wherein one or more of the one or more sensors are:

capable of measuring pulling force, pushing force, rotation, angular motion, velocity, acceleration, force or pressure of grip or pinch, and physiological parameters of the subject;

are disposed within the handle.

* * * * *